US010665090B2

(12) United States Patent
Geerlings et al.

(10) Patent No.: US 10,665,090 B2
(45) Date of Patent: May 26, 2020

(54) TRAINABLE TRANSCEIVER AND MOBILE COMMUNICATIONS DEVICE SYSTEMS AND METHODS

(71) Applicant: GENTEX CORPORATION, Zeeland, MI (US)

(72) Inventors: Steven L. Geerlings, Holland, MI (US); Todd R. Witkowski, Zeeland, MI (US); Thomas S. Wright, Holland, MI (US); Marc A. Smeyers, Zeeland, MI (US); Jonathan E. Dorst, Holland, MI (US); Douglas C. Papay, Zeeland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 16/161,691

(22) Filed: Oct. 16, 2018

(65) Prior Publication Data

US 2019/0051148 A1 Feb. 14, 2019

Related U.S. Application Data

(63) Continuation of application No. 15/484,004, filed on Apr. 10, 2017, now Pat. No. 10,147,310, which is a (Continued)

(51) Int. Cl.
*G08C 17/02* (2006.01)
*G07C 9/00* (2020.01)

(52) U.S. Cl.
CPC ..... *G08C 17/02* (2013.01); *G07C 9/00571* (2013.01); *G07C 2009/00507* (2013.01);

(Continued)

(58) Field of Classification Search
CPC ..... G08C 17/02; G07C 9/00571
See application file for complete search history.

(56) References Cited

U.S. PATENT DOCUMENTS 5,479,155 A * 12/1995 Zeinstra ..... B60R 1/088 340/12.28
2005/0024230 A1* 2/2005 Chuey ..... G08C 17/02 340/12.23

(Continued)

FOREIGN PATENT DOCUMENTS

RU 2010125527 A 12/2011
WO 2008079811 A1 7/2008
WO 2012103394 A1 9/2012

OTHER PUBLICATIONS

European Search Report in reference to Application No. 15779393.6-1857 / 3132432, PCT/US2015026468, dated Sep. 7, 2017, 12 pages.

(Continued)

*Primary Examiner* — Qutbuddin Ghulamali
(74) *Attorney, Agent, or Firm* — Price Heneveld LLP; Bradley D. Johnson

(57) ABSTRACT

A trainable transceiver for controlling a remote device includes a transceiver circuit configured, based on training information, to control the remote device, a communications device configured to communicate with a mobile communications device, an output device, and a control circuit coupled to the transceiver circuit, coupled to the communications device, and coupled to the output device. The control circuit is configured to receive notification information from the mobile communications device via the communications device, and wherein the control circuit is configured to generate an output using the output device based on the notification information.

16 Claims, 12 Drawing Sheets

Related U.S. Application Data continuation of application No. 14/690,242, filed on Apr. 17, 2015, now Pat. No. 9,620,005.

(60) Provisional application No. 61/981,504, filed on Apr. 18, 2014.

(52) U.S. Cl.
CPC ..... *G07C 2009/00753* (2013.01); *G07C 2009/00761* (2013.01); *G07C 2009/00769* (2013.01); *G07C 2009/00793* (2013.01); *G07C 2009/00865* (2013.01); *G07C 2009/00888* (2013.01); *G07C 2009/00928* (2013.01); *G08C 2201/20* (2013.01); *G08C 2201/62* (2013.01); *G08C 2201/91* (2013.01); *G08C 2201/93* (2013.01)

(56) References Cited

U.S. PATENT DOCUMENTS

2005/0054381 A1* 3/2005 Lee ..... G06F 3/011 455/557
2008/0266068 A1* 10/2008 Farrell ..... B60R 25/2072 340/426.17
2008/0291047 A1* 11/2008 Summerford ..... G07C 9/00182 340/5.71

OTHER PUBLICATIONS

Chinese Office Action dated Jan. 3, 2019, in corresponding to Chinese application No. 201580029587.1, 5 pages.
English translation of Chinese Office Action dated Jan. 3, 2019, in corresponding to Chinese application No. 2015800295871, 9 pages.
Chinese Search Report dated Dec. 24, 2018, in corresponding to Chinese application No. 2015800295871, 2 pages.
European Office Action dated Apr. 30, 2019, for corresponding European application No. 15779393.6, 7 pages.
Chinese Search Report dated Jul. 12, 2019, for corresponding Chinese application No. 2015800295871, 2 pages.
English Translation of Second Chinese Office Action dated Jul. 22, 2019, for corresponding Chinese application No. 2015800295871, 10 pages.
Second Chinese Office Action dated Jul. 22, 2019, for corresponding Chinese application No. 2015800295871, 5 pages.

* cited by examiner

TRAINABLE TRANSCEIVER AND MOBILE COMMUNICATIONS DEVICE SYSTEMS AND METHODS

CROSS-REFERENCE TO RELATED APPLICATIONS

This application claims priority under 35 U.S.C. § 120 to U.S. Utility patent application Ser. No. 15/484,004, filed Apr. 10, 2017, entitled "TRAINABLE TRANSCEIVER AND MOBILE COMMUNICATIONS DEVICE SYSTEMS AND METHODS" which claims priority under 35 U.S.C. § 120 to U.S. Utility patent application Ser. No. 14/690,242, filed Apr. 17, 2015, entitled "TRAINABLE TRANSCEIVER AND MOBILE COMMUNICATOINS DEVICE SYSTEMS AND METHODS," which claims priority under 35 U.S.C. § 119 to U.S. Provisional Application No. 61/981,504, filed Apr. 18, 2014, entitled "TRAINABLE TRANSCEIVER AND MOBILE COMMUNICATIONS DEVICE SYSTEMS AND METHODS," each of which is hereby incorporated by reference in its entirety.

BACKGROUND OF THE INVENTION

The present invention relates generally to the field of trainable transceivers for inclusion within a vehicle. A trainable transceiver generally sends and/or receives wireless signals using a transmitter, receiver, and/or transceiver. The wireless signals may be used to control other devices. For example, a trainable transceiver may send a wireless control signal to operate a garage door opener. A trainable transceiver may be trained to operate with a particular device. Training may include providing the trainable transceiver with control information for use in generating a control signal. A trainable transceiver may be incorporated in a vehicle (integrally or contained within the vehicle) and used to control devices outside the vehicle. It is challenging an difficult to develop trainable transceivers which are easy to train to operate a variety of devices. It is further challenging and difficult to develop a trainable transceiver which provides additional useful functions to a user. Additionally, it is challenging and difficult to develop a trainable transceiver which may control other devices for purposes other than providing activation signals. Furthermore, it is challenging and difficult to develop a trainable transceiver which controls other devices based on input or information received from other devices and/or using other hardware.

SUMMARY OF THE INVENTION

One embodiment relates to a trainable transceiver for installation in a vehicle and for controlling a remote device includes a transceiver circuit configured, based on training information, to control the remote device, a communications device configured to communicate with a mobile communications device, an output device, and a control circuit coupled to the transceiver circuit, coupled to the communications device, and coupled to the output device. The control circuit is configured to receive notification information from the mobile communications device via the communications device, and wherein the control circuit is configured to generate an output using the output device based on the notification information.

Another embodiment relates to a trainable transceiver for installation in a vehicle and for controlling a remote device including a transceiver circuit configured based on training information to communicate with the remote device, a communications device configured to communicate with a mobile communications device, an input mechanism, and a control circuit coupled to the transceiver circuit, coupled to the communications device, and coupled to the input mechanism. The control circuit is configured to send a transmission to the mobile communications device via the communications device and in response to an input received via the input mechanism, and wherein the transmission controls the mobile communications device and causes the mobile communications device to perform an action.

Another embodiment relates to a trainable transceiver for installation in a vehicle and for controlling a remote device including a transceiver circuit configured based on training information to communicate with the remote device, a radio frequency transceiver configured to communicate with a mobile communications device, and a control circuit coupled to the transceiver circuit and coupled to the radio frequency transceiver. The control circuit is configured to configured to prevent communication with the remote device unless a key has been received, via the radio frequency transceiver, from the mobile communications device.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
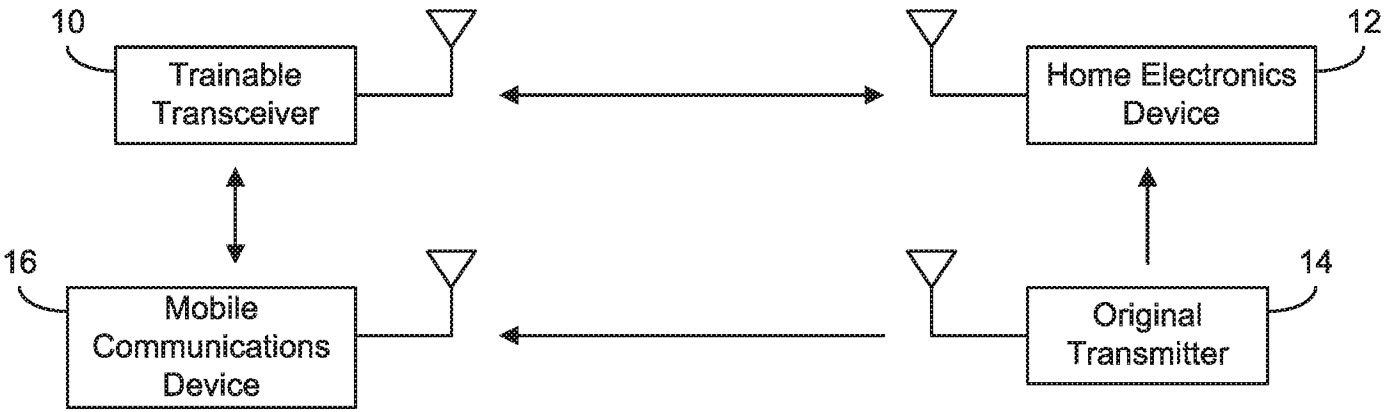
FIG. 1 illustrates communication between a trainable transceiver, mobile electronics device, home electronics device, and original transmitter according to an exemplary embodiment.

Generally, a trainable transceiver controls one or more home electronic devices and/or remote devices. For example, the trainable transceiver may be a Homelink™ trainable transceiver. Home electronic devices may include devices such as a garage door opener, gate opener, lights, security system, and/or other device which is configured to receive activation signals and/or control signals. A home electronic device need not be associated with a residence but can also include devices associated with businesses, government buildings or locations, or other fixed locations. Remote devices may include mobile computing devices such as mobile phones, smartphones, tablets, laptops, computing hardware in other vehicles, and/or other devices configured to receive activation signals and/or control signals.

Activation signals may be wired or, preferably, wireless signals transmitted to a home electronic device and/or remote device. Activation signals may include control signals, control data, encryption information (e.g., a rolling code, rolling code seed, look-a-head codes, secret key, fixed code, or other information related to an encryption technique), or other information transmitted to a home electronic device and/or remote device. Activation signals may have parameters such as frequency or frequencies of transmission (e.g., channels), encryption information (e.g., a rolling code, fixed code, or other information related to an encryption technique), identification information (e.g., a serial number, make, model or other information identifying a home electronic device, remote device, and/or other device), and/or other information related to formatting an activation signal to control a particular home electronic device and/or remote device.

In some embodiments, the trainable transceiver receives information from one or more home electronic devices and/or remote devices. The trainable transceiver may receive information using the same transceiver user to send activation signals and/or other information to home electronic devices and/or remote devices. The same wireless transmission scheme, protocol, and/or hardware may be used from transmitting and receiving. The trainable transceiver may have two way communication with home electronic devices and/or remote devices. In other embodiments, the trainable transceiver includes additional hardware for two way communication with devices and/or receiving information from devices. In some embodiments, the trainable transceiver has only one way communication with a home electronic device and/or remote device (e.g., sending activation signals to the device). The trainable transceiver may receive information about the home electronic device and/or remote device using additional hardware. The information about the home electronic device and/or remote device may be received from an intermediary device such as an additional remote device and/or mobile communication device.

A trainable transceiver may also receive information from and/or transmit information to other devices configured to communicate with the trainable transceiver. For example, a trainable transceiver may receive information for cameras (e.g., imaging information may be received) and/or other sensors. The cameras and/or other sensors may communicate with a trainable transceiver wirelessly (e.g., using one or more transceivers) or through a wired connection. In some embodiments, a trainable transceiver may communicate with mobile communications devices (e.g., cell phones, tablets, smartphones, or other communication devices). In some embodiments, mobile communications devices may include other mobile electronics devices such as laptops, personal computers, and/or other devices. In still further embodiments, the trainable transceiver is configured to communicate with networking equipment such as routers, servers, switches, and/or other hardware for enabling network communication. The network may be the internet and/or a cloud architecture.

In some embodiments, the trainable transceiver transmits and/or receives information (e.g., activation signals, control signals, control data, status information, or other information) using a radio frequency signal. For example, the transceiver may transmit and/or receive radio frequency signals in the ultra-high frequency range, typically between 260 and 960 megahertz (MHz) although other frequencies may be used. In other embodiments, a trainable transceiver may include additional hardware for transmitting and/or receiving signals (e.g., activation signals and/or signals for transmitting and/or receiving other information). For example, a trainable transceiver may include a light sensor and/or light emitting element, a microphone and/or speaker, a cellular transceiver, an infrared transceiver, or other communication device.

A trainable transceiver may be configured (e.g., trained) to send activation signals and/or other information to a particular device and/or receive control signals and/or information from a particular device. The trainable transceiver may be trained by a user to work with particular remote devices and/or home electronic devices (e.g., a garage door opener). For example, a user may manually input control information into the trainable transceiver to configure the trainable transceiver to control the device. A trainable transceiver may also learn control information from an original transmitter. A trainable transceiver may receive a signal containing control information from an original transmitter (e.g., a remote sold with a home electronic device) and determine control information from the received signal. Training information (e.g., activation signal frequency, device identification information, encryption information, modulation scheme used by the device, or other information related to controlling a device via an activation signal) may also be received by a trainable transceiver from a remote device, mobile communications device, or other source.

A trainable transceiver may be mounted or otherwise attached to a vehicle in a variety of locations. For example, a trainable transceiver may be integrated into a dashboard or center stack (e.g., infotainment center) of a vehicle. The trainable transceiver may be integrated into the vehicle by a vehicle manufacturer. A trainable transceiver may be located in other peripheral locations. For example, a trainable transceiver may be removably mounted to a visor. The trainable transceiver may include mounting hardware such as a clip. A trainable transceiver may be mounted to other surfaces of a vehicle (e.g., dashboard, windshield, door panel, or other vehicle component). For example, a trainable transceiver may be secured with adhesive. In some embodiments, a trainable transceiver is integrated in a rear view mirror of the vehicle. A vehicle manufacturer may include a trainable transceiver in the rear view mirror.

In other embodiments, a vehicle may be retrofit to include a trainable transceiver. This may include attaching a trainable transceiver to a vehicle surface using a clip, adhesive, or other mounting hardware as described above. Alternatively, it may include replacing a vehicle component with one that includes an integrated trainable transceiver and/or installing a vehicle component which includes an integrated trainable transceiver. For example, an aftermarket rear view mirror, vehicle camera system (e.g., one or more cameras and one or more display screens), and/or infotainment center may include an integrated trainable transceiver. In further embodiments, one or more components of a trainable transceiver may be distributed within the vehicle.

Referring now to FIG. 1, a trainable transceiver 10 may communicate with a home electronics device 12. In some embodiments, the trainable transceiver 10 and home electronics device 12 communicate using two way communication. For example, the trainable transceiver 10 may transmit activation signals, control signals, requests for information, data and/or other information to the home electronics device 12. The home electronics device 12 may transmit, status information, responses to requests for information, data, requests for information, and/or other information to the trainable transceiver 10. The same and/or similar two way communication may be made between the trainable transceiver 10 and a remote device. In other embodiments, there is only one way communication between the trainable transceiver 10 and the home electronics device 12 and/or remote device. For example, the trainable transceiver 10 transmits activation signals, control signals, data, and/or other information to the home electronics device 12 and/or remote device, and the trainable transceiver 10 does not receive transmissions from the home electronics device 12 or remote device.

In some embodiments, an original transmitter 14 may communicate with the home electronics device 12 and/or remote device. In one embodiment, the original transmitter 14 communicates with the home electronics device 12 and/or remote device using one way communication. For example, the original transmitter 14 may transmit an activation signal to the home electronics device 12 and/or remote device. In some embodiments, the original transmitter 14 may be the source of an activation signal, activation signal parameters, and/or other information related to controlling the home electronics device 12 and/or remote device. This information may be received by a mobile communications device 16 as discussed in greater detail herein. In alternative embodiments, the original transmitter 14 is capable of two way communication. In some embodiments, the trainable transceiver 10 may be configured to receive an activation signal and/or other information from the original transmitter 14.

In one embodiment, the trainable transceiver 10 is capable of two way communication with the mobile communications device 16. For example, a smartphone may be paired with the trainable transceiver 10 such that the trainable transceiver 10 and smartphone communicate using wireless transceivers (e.g., using radio frequency transceivers and/or a protocol such as Bluetooth communication). The trainable transceiver 10 and mobile communications device 16 may exchange information such as status, notifications, activation signals, training information, activation signal parameters, device identification information (e.g., the serial number, make, and/or model of the home electronics device 12), and/or other information.

In some embodiments, the communication described herein with respect to FIG. 1 is wireless communication. In other embodiments, communication may be wired communication. For example, communication between two or more devices may use a wireless network, wireless transceiver, and/or wireless communication protocol (e.g., WiFi, Zigbee, Bluetooth, cellular, etc.), a wired interface and/or protocol (e.g., Ethernet, universal serial bus (USB), Firewire, etc.), or other communications connection (e.g. infrared, optical, ultrasound, etc.).

Figure 2A:
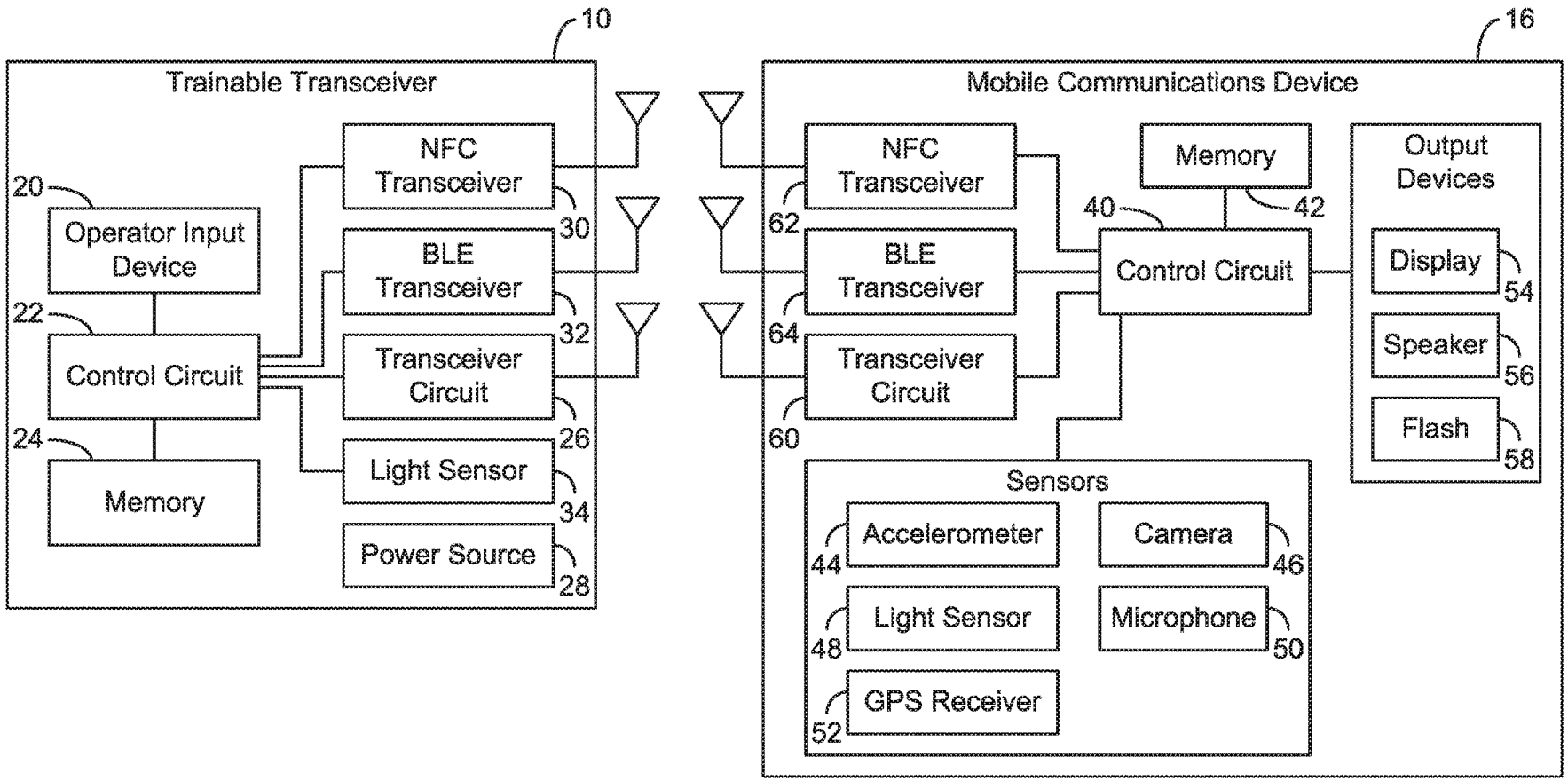
FIG. 2A illustrates a trainable transceiver and a mobile communications device including components for communication using radio frequency transmissions and light transmissions according to an exemplary embodiment.

Referring now to FIG. 2A, an exemplary embodiment of the trainable transceiver 10 is illustrated along with an exemplary embodiment of the mobile communications device 16. In one embodiment, the trainable transceiver 10 includes an operator input device 20. The operator input device 20 may be one or more buttons. For example, the operator input device 20 may be three hard key buttons. In some embodiments, the operator input device 20 may include input devices such as touchscreen displays, switches, microphones, knobs, touch sensor (e.g., projected capacitance sensor resistance based touch sensor, resistive touch sensor, or other touch sensor), proximity sensors (e.g., projected capacitance, infrared, ultrasound, infrared, or other proximity sensor), or other hardware configured to generate an input from a user action. In additional embodiments, the operator input device 20 may display data to a user or other provide outputs. For example, the operator input device 20 may include a display screen (e.g., a display as part of a touchscreen, liquid crystal display, e-ink display, plasma display, light emitting diode (LED) display, or other display device), speaker, haptic feedback device (e.g., vibration motor), LEDs, or other hardware component for providing an output. In some embodiments, the operator input device 20 is connected to a control circuit 22. The control circuit 22 may send information and or control signals or instructions to the operator input device 20. For example, the control circuit 22 may send output instructions to the operator input device 20 causing the display of an image. The control circuit 22 may also receive input signals, instructions, and/or data from the operator input device 20.

The control circuit 22 may include various types of control circuitry, digital and/or analog, and may include a microprocessor, microcontroller, application-specific integrated circuit (ASIC), graphics processing unit (GPU), or other circuitry configured to perform various input/output, control, analysis, and other functions to be described herein. In other embodiments, the control circuit 22 may be a SoC individually or with additional hardware components described herein. The control circuit 22 may further include, in some embodiments, memory (e.g., random access memory, read only memory, flash memory, hard disk storage, flash memory storage, solid state drive memory, etc.). In further embodiments, the control circuit 22 may function as a controller for one or more hardware components included in the trainable transceiver 10. For example, the control circuit 22 may function as a controller for a touch-screen display or other operator input device 20, a controller for a transceiver, transmitter, receiver, or other communication device (e.g., implement a Bluetooth communications protocol).

In some embodiments, the control circuit 22 receives inputs from operator input devices 20 and processes the inputs. The inputs may be converted into control signals, data, inputs to be sent to the base station, etc. The control circuit may control a transceiver circuit 26 and use the transceiver circuit 26 to communicate (e.g., receive signals and/or transmit signals) with one or more of original transmitters 14, home electronic devices 12, mobile communications devices 16, and/or remote devices. The control circuit 22 may also be used to in the training process.

The control circuit 22 is coupled to memory 24. The memory 24 may be used to facilitate the functions of the trainable transceiver described herein. Memory 24 may be volatile and/or non-volatile memory. For example, memory 24 may be random access memory, read only memory, flash memory, hard disk storage, flash memory storage, solid state drive memory, etc. In some embodiments, the control circuit 22 reads and writes to memory 24. Memory 24 may include computer code modules, data, computer instructions, or other information which may be executed by the control circuit 22 or otherwise facilitate the functions of the trainable transceiver 10 described herein. For example, memory 24 may include encryption codes, pairing information, identification information, a device registry, etc.

The transceiver circuit 26 allows the trainable transceiver 10 to transmit and/or receive wireless communication signals. The wireless communication signals may be transmitted to or received from a variety of wireless devices (e.g., the original transmitter 14, home electronic device 12, mobile communications device 16, and/or remote device). The transceiver circuit 26 may be controlled by the control circuit 22. For example, the control circuit 22 may turn on or off the transceiver circuit 26, the control circuit 22 may send data using the transceiver circuit 26, format information, an activation signal, control signal, and/or other signal or data for transmission via the transceiver circuit 26, or otherwise control the transceiver circuit 26. Inputs from the transceiver circuit 26 may also be received by the control circuit 22. In some embodiments, the transceiver circuit 26 may include additional hardware such as processors, memory, integrated circuits, antennas, etc. The transceiver circuit 26 may process information prior to transmission or upon reception and prior to passing the information to the control circuit 22. In some embodiments, the transceiver circuit 26 may be coupled directly to memory 24 (e.g., to store encryption data, retrieve encryption data, etc.). In further embodiments, the transceiver circuit 26 may include one or more transceivers, transmitters, receivers, etc. For example, the transceiver circuit 26 may include an optical transceiver, near field communication (NFC) transceiver, etc. In some embodiments, the transceiver circuit 26 may be implemented as a SoC.

In further embodiments, the control circuit 22 is coupled to additional transceiver circuits, receivers, and/or transmitters. In one embodiment, the transceiver circuit 26 is used for communicating with (transmitting to and/or receiving from) home electronic devices and/or remote devices. In some embodiments, the transceiver circuit 26 may be or include a cellular transceiver. The trainable transceiver 10 may use the transceiver circuit 26 and/or an additional transceiver (e.g., a cellular transceiver) to access the internet, other networks, and/or network hardware. In other embodiments, the trainable transceiver 10 may access the internet, other networks, and/or network hardware through an intermediate device in communication with the trainable transceiver 10 such as the mobile communications device 16.

Additional transceivers may be used to communicate with other devices (e.g., mobile communications devices, cameras, network devices, or other wireless devices). The transceiver circuit 26 and other transceivers may operate using different frequency, transmission spectrums, protocols, and/or otherwise transmit and/or receive signals using different techniques. For example, the transceiver circuit 26 may be configured to send activation signals to the home electronic device 12 (e.g., a garage door opener) using an encrypted radio wave transmission and an additional transceiver may communicate with a remote communications device (e.g., a smartphone) using a Bluetooth transceiver and Bluetooth communications protocol.

The trainable transceiver 10 may communicate with original transmitters 14, home electronic devices 12, remote devices, mobile communications devices 16, network devices, and/or other devices as described above using the transceiver circuit and/or other additional transceiver circuits or hardware. The devices with which the trainable transceiver communicates may include transceivers, transmitters, and/or receivers. The communication may be one-way or two-way communication.

With continued reference to FIG. 2A, the trainable transceiver 10 may include a power source 28. The power source 28 provides electrical power to the components of the trainable transceiver 10. In one embodiment, the power source 28 is self-contained. For example, the power source 28 may be a battery, solar cell, or other power source not requiring a wired connection to another source of electrical power. In other embodiments, the power source 28 may be a wired connection to another power source. For example, the power source 28 may be a wired connection to a vehicle power supply system. The power source 28 may be integrated into the vehicle electrical system. This may allow the trainable transceiver 10 to draw electrical power from a vehicle battery, be turned on or off by a vehicle electrical system (e.g., turned off when the vehicle is turned off, turned on when a vehicle door is opened, etc.), draw power provided by a vehicle alternator, or otherwise be integrated with the electrical power systems(s) of the vehicle.

In some embodiments, the trainable transceiver 10 includes a near field communication (NFC) transceiver 30. The NFC transceiver 30 may be used to communicate with the mobile communications device 16 and/or other device. For example, the NFC transceiver 30 may be used to pair the mobile communications device 16 such as a smartphone and the trainable transceiver 10. The pairing process may be conducted using NFC. In some embodiments, additional information may be communicated between the trainable transceiver 10 and the mobile communications device 16 and/or other device using NFC.

In some embodiments, the trainable transceiver 10 includes a Bluetooth Low Energy (BLE) transceiver 32. The BLE transceiver 32 may be a radio frequency transceiver configured to communicate using the Bluetooth Low Energy protocol. In other embodiments, the BLE transceiver 32 may be a radio frequency transceiver configured to communicate using a different protocol, such as a Bluetooth protocol (e.g., v2.0, v3.0, v4.0, etc.). The BLE transceiver 32 may facilitate pairing of the trainable transceiver 10 and the mobile communications device 16. For example, the trainable transceiver 10 and mobile communications device 16 may establish a communication connection using the BLE transceiver 32 and exchange information relevant to pairing the two devices for further communication using a BLE protocol. Upon pairing (e.g., using the BLE transceiver 32, NFC transceiver 30, and/or other techniques), the trainable transceiver 10 may communicate with the mobile communications device 16 using the BLE transceiver 32.

In further embodiments, the trainable transceiver 10 may include a speaker and/or microphone. The speaker may be used to provide audio output to a user. The microphone may be used receive user inputs (e.g., voice commands). In further embodiments, the microphone and/or speaker may be used to receive and/or send information using sound waves.

The mobile communications device 16, which may communicate with the trainable transceiver 10 in some embodiments of the trainable transceiver 10, may be a device purchased by a consumer separately from the trainable transceiver 10. For example, the mobile communications device 16 may be a cell phone purchased from a third party retailer. In some embodiments, the mobile communications device 16 (e.g., smartphone, tablet, cellular telephone, laptop, key fob, dongle, etc.) includes a control circuit 40. The control circuit 40 may contain circuitry, hardware, and/or software for facilitating and/or performing the functions described herein. The control circuit 40 may handle inputs, process inputs, run programs, handle instructions, route information, control memory, control a processor, process data, generate outputs, communicate with other devices or hardware, and/or otherwise perform general or specific computing tasks. In some embodiments, the control circuit 40 includes a processor. In some embodiments, the control circuit 40 includes memory. The control circuit 40 may handle computation tasks associated with placing phone calls, running an operating system, running applications, displaying information, general computing, and/or tasks associated with providing smartphone, tablet, laptop and/or other device functions. In some embodiments, the control circuit 40 may include and/or be one more systems on a chip (SoCs), application specific integrated circuits (ASICs), one or more field programmable gate arrays (FPGAs), a digital-signal-processor (DSP), a group of processing components, and/or other suitable electronic processing components.

The mobile communications device 16 may include memory 42. Memory 42 is one or more devices (e.g. RAM, ROM, Flash Memory, hard disk storage, etc.) for storing data and/or computer code for facilitating the various processes described herein. Memory 42 may be or include non-transient volatile memory or non-volatile memory. Memory 42 may include database components, object code components, script components, or any other type of information structure for supporting various activities and information structures described herein. Memory 42 may be communicably connected to the control circuit 40 and provide computer code and/or instructions to the control circuit 40 for executing the processes described herein. For example, memory 42 may contain computer code, instructions, and/or other information of implementing an operating system, one or more applications, and/or other programs.

In some embodiments, the mobile communications device 16 includes one or more sensors. The sensors may be controlled by the control circuit 40, provide inputs to the control circuit 40, and/or otherwise interact with the control circuit 40. In some embodiments, sensors include one or more accelerometers 44, cameras 46, light sensors 48, microphones 50, and/or other sensors or input devices. Sensors may further include a global positioning system (GPS) receiver 52. The GPS receiver 52 may receive position information from another source (e.g., a satellite). The position may be based on GPS coordinates.

The mobile communications device 16 may include output devices. In some embodiments, the output devices are controlled by the control circuit 40, provide input to the control circuit 40, communicate output from the control circuit 40 to a user or other device, and/or are otherwise in communication with the control circuit 40. Output devices may include a display 54. The display 54 allows for visual communication with a user. The display 54 may be configured to output a visual representation based on computer instructions, control signals, computer code, frame buffers, and/or other electronic signals or information. In some embodiments, the display 54 includes a graphics processing unit (GPU), controller, and/or other hardware to facilitate the handling of and display of graphics information. In other embodiments, the display 54 does not include hardware for processing images or image data. The display 54 may be any hardware configured to display images using the emission of light or another technique. For example, the display 54 may be a liquid crystal display, e-ink display, plasma display, light emitting diode (LED) display, or other display device. In some embodiments, the display 54 may be part of or otherwise integrated with a user input device such as a touchscreen display (e.g., projected capacitance touchscreen, resistance based touchscreen, and/or touchscreen based on other touch sensing technology). The 54 display may be a touchscreen display. Output devices may also include a speaker 56 for providing audio outputs. Output devices may further include a flash 58. The flash 58 may be associated with the camera 46 and may be an LED or other light source.

The mobile communications device 16 may include a transceiver circuit 60. The transceiver circuit 60 may be a radio frequency transceiver, cellular transceiver, and/or other transceiver. The transceiver circuit 60 may provide communication between the mobile communications device 16 and a cell tower, voice network, data network, communication network, other device, and/or other hardware components used in communication. The mobile communications device 16 may access the internet and/or other networks using the transceiver circuit 60. In some embodiments, the trainable transceiver 10 and mobile communications device 16 communicate using the transceiver circuit 60 of the mobile communications device 16 and the transceiver circuit 26 of the trainable transceiver 10. Other intermediary devices and/or hardware (e.g., network components) may facilitate communication between the mobile communications device 16 and the trainable transceiver 10. In some embodiments, the mobile communications device 16 may have access to activation signal parameters, training information (e.g., device identification information), and/or other information related to the home electronics device 12 and/or remote device. The mobile communications device 16 may have access to this information through a variety of sources and techniques as discussed in more detail herein. The mobile communications device 16 may transmit activation signal parameters, training information (e.g., device identification information), and/or other information related to the home electronics device 12 and/or remote device using the transceiver circuit 60 of the mobile communications device 16. This information may be received by the trainable transceiver 10 using the transceiver circuit 26 of the trainable transceiver 10.

In some embodiments, the mobile communications device 16 includes an NFC transceiver 62. The NFC transceiver 62 may allow the mobile communications device to wirelessly communicate with the trainable transceiver 10 using NFC. As discussed above, the NFC transceiver 62 of the mobile communications device 16 and the NFC transceiver 30 of the trainable transceiver 10 may allow for wireless communication between the trainable transceiver 10 and the mobile communications device 16. In some embodiments, the wireless communication via the NFC transceivers allows for the trainable transceiver 10 and mobile communications device 16 to be paired and therefore allow for further communication using the NFC transceivers and/or other transceivers described herein. In some embodiments, the mobile communications device 16 may have access to activation signal parameters, training information (e.g., device identification information), and/or other information related to the home electronics device 12 and/or remote device. The mobile communications device 16 may have access to this information through a variety of sources and techniques as discussed in more detail herein. The mobile communications device 16 may transmit activation signal parameters, training information (e.g., device identification information), and/or other information related to the home electronics device 12 and/or remote device using the NFC transceiver 62 of the mobile communications device 16. This information may be received by the trainable transceiver 10 using the NFC transceiver 30 of the trainable transceiver 10.

In some embodiments, the mobile communications device 16 includes a BLE transceiver 64. The BLE transceiver 64 may allow the mobile communications device 16 to wirelessly communicate with the trainable transceiver 10 using a Bluetooth protocol such as BLE. As discussed above, the BLE transceiver 64 of the mobile communications device 16 and the BLE transceiver 32 of the trainable transceiver 10 may allow for wireless communication between the trainable transceiver 10 and the mobile communications device 16. In some embodiments, the wireless communication via the BLE transceivers allows for the trainable transceiver 10 and mobile communications device 16 to be paired and therefore allow for further communication using the BLE transceivers and/or other transceivers described herein. Alternatively, the trainable transceiver 10 and the mobile communications device 16 may be paired by another technique (e.g., using the NFC transceivers) which allows for further communication using BLE transceivers. In some embodiments, the mobile communications device 16 may have access to activation signal parameters, training information (e.g., device identification information), and/or other information related to the home electronics device 12 and/or remote device. The mobile communications device 16 may have access to this information through a variety of sources and techniques as discussed in more detail herein. The mobile communications device 16 may transmit activation signal parameters, training information (e.g., device identification information), and/or other information related to the home electronics device 12 and/or remote device using the BLE transceiver 64 of the mobile communications device 16. This information may be received by the trainable transceiver 10 using the BLE transceiver 32 of the trainable transceiver 10.

With continued reference to FIG. 2A, the trainable transceiver may include a light sensor 34 (e.g., photodetector) in some embodiments. As described above, the mobile communications device 16 may include the light sensor 48 and the display 54, flash 58, and/or other light source. The light sensor 3464 of the trainable transceiver 10 may be configured to receive information transmitted from a source, such as the mobile communications device 16, using light.

Figure 2B:
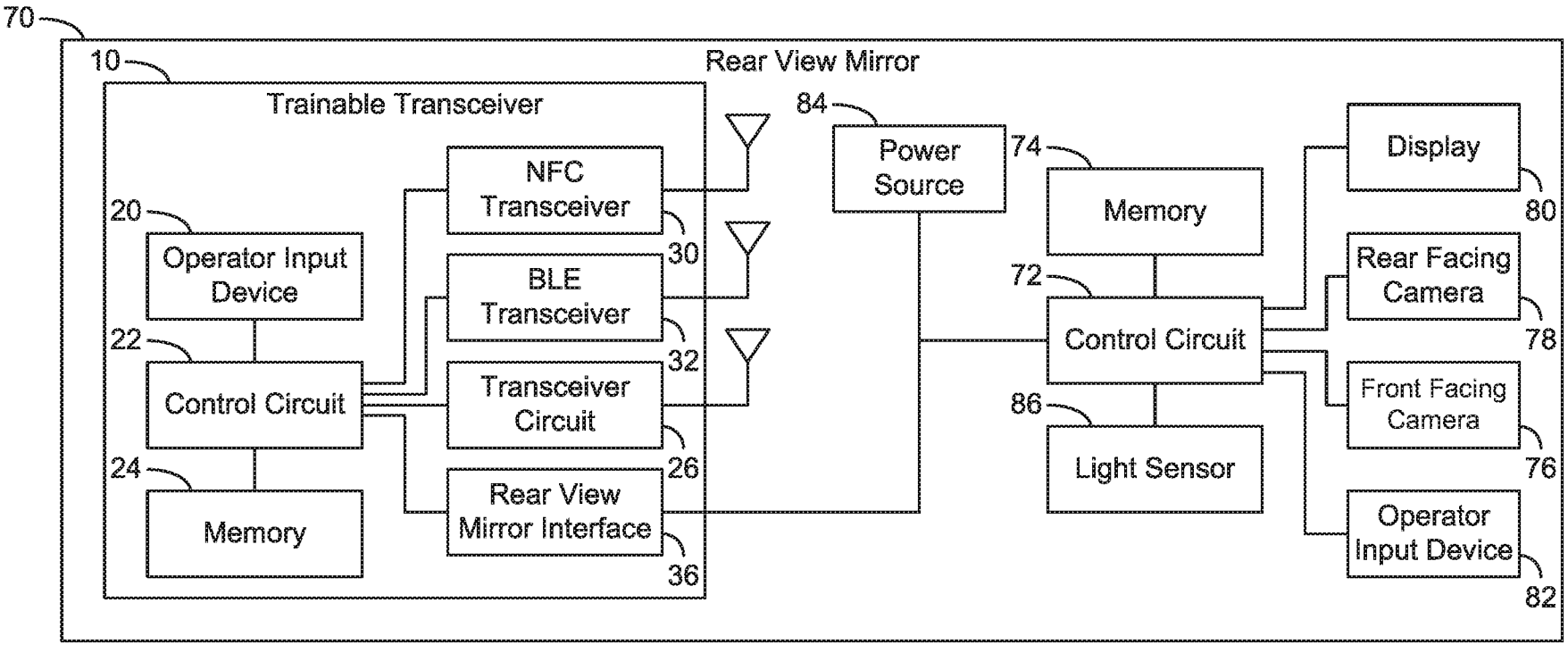
FIG. 2B illustrates a trainable transceiver integrated with a rear view mirror of a vehicle including a light sensor according to an exemplary embodiment.

Referring now to FIG. 2B, the trainable transceiver 10 may be coupled to, integrated with, and/or otherwise be in communication with a rear view mirror 70 of the vehicle. Advantageously, this may allow the trainable transceiver 10 to use hardware associated with the rear view mirror 70 rather than duplicating the same hardware for use with the trainable transceiver 10. This may save cost, simplify the manufacturing process, and/or otherwise improve the trainable transceiver system. The rear view mirror 70 may be installed in a vehicle as part of an original vehicle manufacturing process, as an additional piece of hardware, as part of a retrofit instillation, to replace an existing mirror, or otherwise be added to a vehicle. The rear view mirror 70 may be uninstalled in a vehicle (e.g., packaged for sale for later installation in a vehicle).

In one embodiment, the rear view mirror 70 includes a control circuit 72. The control circuit 72 may contain circuitry, hardware, and/or software for facilitating and/or performing the functions described herein. The control circuit 72 may handle inputs, process inputs, run programs, handle instructions, route information, control memory, control a processor, process data, generate outputs, communicate with other devices or hardware, and/or otherwise perform general or specific computing tasks. In some embodiments, the control circuit 72 includes a processor. The processor may be implemented as a general-purpose processor, an application specific integrated circuit (ASIC), one or more field programmable gate arrays (FPGAs), a digital-signal-processor (DSP), a group of processing components, or other suitable electronic processing components.

In some embodiments, the control circuit 72 is coupled to memory 74. Memory 74 is one or more devices (e.g. RAM, ROM, Flash Memory, hard disk storage, etc.) for storing data and/or computer code for facilitating the various processes described herein. Memory 74 may be or include non-transient volatile memory or non-volatile memory. Memory 74 may include database components, object code components, script components, or any other type of information structure for supporting various activities and information structures described herein. Memory 74 may be communicably connected to the control circuit 72 and provide computer code or instructions to the control circuit 72 for executing the processes described herein.

In some embodiments, the rear view mirror 70 includes one or more front facing cameras 76 and/or one or more rear facing cameras 78. The front facing camera 76 may be used alone or in conjunction with the control circuit 72 of the rear view mirror 70 to perform a variety of functions. For example, the front facing camera 76 may be used to provide driver aids such as automatically dimming headlights when oncoming cars are detected (e.g., by the headlights of the oncoming car).

In one embodiment, the rear view mirror 70 includes a display 80. The display 80 allows for visual communication with a user. The display 80 may be configured to output a visual representation based on computer instructions, control signals, computer code, frame buffers, and/or other electronic signals or information. In some embodiments, the display 80 includes a graphics processing unit (GPU), controller, and/or other hardware to facilitate the handling of and display of graphics information. In other embodiments, the display 80 does not include hardware for processing images or image data. The display 80 may be any hardware configured to display images using the emission of light or another technique. For example, the display 80 may be a liquid crystal display, e-ink display, plasma display, light emitting diode (LED) display, or other display device. In some embodiments, the display 80 may be part of or otherwise integrated with a user input device such as a touchscreen display (e.g., projected capacitance touchscreen, resistance based touchscreen, and/or touchscreen based on other touch sensing technology). The display 80 be a touchscreen display. In some embodiments, the display 80 is controlled by the control circuit 72 of the rear view mirror 70. The display 80 may be used for functions such as displaying weather information, backup camera video feeds, warnings, compass heading, road information (e.g., current speed limit), navigation information, vehicle information (e.g., if a passenger is not wearing a seat belt), or information accessible by the vehicle and/or a vehicle connected device (e.g., paired smartphone). The display 80 may be located behind the glass of the mirror assembly itself. The display 80 may be used to display images but, when not in use, function as part of the mirror, allowing a user to see towards the rear of the vehicle.

In some embodiments, the rear view mirror includes an operator input device 82. The operator input device 82 may allow a user to provide inputs to the control circuit 72 of the rear view mirror 70. The operator input device 82 may include soft keys (touch screens, projected capacitance based buttons, resistance based buttons, etc.) and/or hard keys (e.g., buttons, switches knobs, etc.), microphones, and/or other hardware configured to accept user inputs. The operator input device 82 may allow a user to control functions associated with the rear view mirror 70 such as dimming, turning on or off auto dimming, placing an emergency call, etc. The operator input device 82 of the rear view mirror 70 is coupled to the control circuit 72 of the rear view mirror 70. The rear view mirror 70 may process inputs received from the operator input device 82 (e.g., change the display, dim the mirror, play a sound using the speaker, or otherwise take an action, process the input, and/or generate an output).

In one embodiment, the rear view mirror includes a power source 84. The power source 84 may be a replaceable or rechargeable battery. In other embodiments, the power source 84 may be a connection to a vehicle electrical system. For example, the components of the rear view mirror 70 may draw electrical power from a controller area network (CAN) bus, vehicle battery, vehicle alternator, and/or other vehicle system to which the components of the rear view mirror 70 are electrically connected.

In some embodiments, the rear view mirror 70 includes an integral transceiver, such as a cellular transceiver, Bluetooth transceiver, etc., or a connection to a transceiver coupled to the vehicle in which the rear view mirror 70 is or will be mounted. Using this transceiver and/or additional hardware, the rear view mirror 70 may have or be capable of providing access to the internet and/or communication to other devices and/or hardware (e.g., using radio frequency transmissions).

The rear view mirror 70 may include one or more sensors. For example, the rear view mirror 70 may include light sensors 86, temperature sensors, accelerometers, humidity sensors, microphones, and/or other sensors. Sensors may be used to display information to an occupant of vehicle (e.g., current weather conditions) using the display 80 of the rear view mirror 70 and/or other displays in the vehicle (e.g., center stack display, gauge cluster display, heads up display (HUD), etc.). Sensors may also be used to accept user input and/or measure parameters related to the vehicle. For example, the microphone may be used to accept voice commands from an occupant of the vehicle. In some embodiments, the control circuit 72 of the rear view mirror 70 may transmit, communicate, and/or otherwise pass sensor data, signals, outputs, and/or other information to other hardware (e.g., the trainable transceiver 10).

With continued reference to FIG. 2B, the trainable transceiver 10 includes a rear view mirror interface 36 in some embodiments. The rear view mirror interface 36 may allow for communication between the trainable transceiver 10 and the control circuit 72 of the rear view mirror 70. In one embodiment, rear view mirror interface 36 includes physical connection such as ports, connectors, wiring, and/or other hardware used to create an electrical connection between the control circuit 22 of the trainable transceiver 10 and the control circuit 72 of the rear view mirror 70. In alternative embodiments, the control circuit 22 of the trainable transceiver 10 and the control circuit 72 of the rear view mirror 70 are directly connected (e.g., wired such that outputs from one control circuit are received as inputs at the other control circuit and/or vice versa). In further embodiments, the rear view mirror interface 36 may include and/or be implemented by computer programing, code, instructions, or other software stored in memory in the trainable transceiver 10 and/or rear view mirror 70. Advantageously, the connection between the trainable transceiver 10 and the rear view mirror 70 may allow for components of the rear view mirror 70 to serve two or more functions thus increasing the usefulness of these components, reducing cost, and/or eliminating the need for duplicate components to provide additional functions to the trainable transceiver 10. For example, the display 80 of the rear view mirror 70 may be used to communicate information relevant to the operation of the rear view mirror 70 (e.g., weather information, if the mirror is set to automatically dim, vehicle warnings, etc.) and information relevant to the trainable transceiver 10 (e.g., training steps, pairing information, whether an activation signal has been received, status information regarding a home electronics device, mobile communications device, and/or remote device, and/or other information related to the trainable transceiver 10).

The connection between the trainable transceiver 10 and the rear view mirror hardware may allow the trainable transceiver 10 to control the hardware included in the rear view mirror 70, send control signals and/or instructions to the control circuit 72 of the rear view mirror 70, receive images and/or image data from the camera(s) 76 and/or 78 included in the rear view mirror 70 (e.g., via the control circuit 72 of the rear view mirror), receive control signals and/or instructions, receive sensor information from sensors included in the rear view mirror 70 (e.g., via the control circuit 72 of the rear view mirror 70), and/or otherwise interact with the rear view mirror 70 and/or components thereof.

The trainable transceiver 10 may be configured to control, communicate, or otherwise operate in conjunction with the control circuit 72 of the rear view mirror 70 to facilitate and/or perform the functions described herein. In one embodiment, the trainable transceiver 10 communicates with the control circuit 72 of the rear view mirror 70 through the rear view mirror interface 36. In other embodiments, the trainable transceiver 10 communicates with the control circuit 72 of the rear view 70 mirror directly (e.g., the control circuit 22 of the trainable transceiver communicates with the control circuit of the rear view mirror). The trainable transceiver may communicate and/or control the control circuit of the rear view mirror using a variety of techniques. For example, the trainable transceiver may communicate with the rear view mirror through outputs from the trainable transceivers received as inputs at the control circuit of the rear view mirror, sending the rear view mirror a location in memory which contains information instructions, data, or other information which is read by the control circuit of the rear view mirror, sending the control circuit of the rear view mirror data, instructions, or other information through a bus, port, or other connection, or otherwise providing instructions, data, or information to the control circuit of the rear view mirror.

In some embodiments, the control circuit 72 of the rear view mirror 70 communicates with the control circuit 22 of the trainable transceiver 10 using similar techniques. In other embodiments, the communication is one way with the trainable transceiver 10 sending instructions, data, or other information to the control circuit 72 of the rear view mirror 70. The trainable transceiver 10 may extract data, instructions, or other information from the control circuit 72 of the rear view mirror 70 by reading the memory 74 of the rear view mirror 70 and/or requesting from the control circuit 72 of the rear view mirror 70 an address for a location in memory 74 in which the relevant information can be read. Alternatively, the control circuit 72 of the rear view mirror 70 may send information to the trainable transceiver 10 but only when requested by the trainable transceiver 10.

In one embodiment, the trainable transceiver 10 is configured to provide output to a vehicle occupant using the display 80 and/or speaker of the rear view mirror 70. The trainable transceiver 10 may control the output of the rear view mirror 70 by sending control signals, instructions, information, and/or data to the rear view mirror 70 or otherwise control the display 80 and/or speaker of the rear view mirror 70. In one embodiment, the trainable transceiver 10 controls the output of the rear view mirror 70 using the rear view mirror interface 36. For example, the rear view mirror interface 36 may format instructions, control signals, and/or information such that it can be received and/or processed by the control circuit 72 of the rear view mirror 70. In other embodiments, the control circuit 22 of the trainable transceiver 10 may communicate directly with the control circuit 72 of the rear view mirror 70. The control circuit 72 of the rear view mirror 70 may handle, process, output, forward and/or otherwise manipulate instructions, control signals, data, and/or other information from the trainable transceiver 10. In other embodiments, the control circuit 72 of the rear view mirror 70 forwards, routes, or otherwise directs the instructions, control signals, outputs, data, and/or other information to other components of the rear view mirror 70 without additional processing or manipulation. For example, the trainable transceiver 10 may output a frame buffer to the control circuit 72 of the rear view mirror 70 which then routes the frame buffer to the display 80 without further manipulation. This may include storing the frame buffer in memory included in the control circuit 72 of the rear view mirror 70 and sending an address corresponding to the frame buffer to the display 80. As described in greater detail with respect to later figures, the display 80 may be used by the trainable transceiver 10 to communicate information to a vehicle occupant regarding the home electronics device 12, remote device, mobile communications device 16, or other device controlled by and/or in communication with the trainable transceiver 10.

Advantageously, displaying information related to the trainable transceiver 10 using the display 80 of the rear view mirror 70 may make a user more likely to view the information. Vehicle occupants, particularly the driver, are accustomed to looking at the rear view mirror 70 frequently. A vehicle driver may be particularly likely to look at the rear view mirror 70 while reversing out of a garage and/or down a driveway. As such, a vehicle driver is more likely to see information from the trainable transceiver 10 related to the home electronics device 12 (e.g., a garage door opener) if the information is displayed on the rear view mirror 70 rather than in another location.

The trainable transceiver 10 may be configured to receive inputs from the sensors of the rear view mirror and/or control sensors of the rear view mirror 70. The trainable transceiver 10 may access sensor data and/or control sensor data through the rear view mirror interface 36 and/or the control circuit 72 of the rear view mirror 70. In other embodiments, sensor data may be accessed and/or sensors controlled by the control circuit 22 of the trainable transceiver 10 and/or the control circuit 72 of the rear view mirror 70. The trainable transceiver 10 may receive sensor data and process, transmit, format, send data to other devices, and/or otherwise manipulate the sensor data. The trainable transceiver 10 may also control sensors. For example, the trainable transceiver 10 may turn sensors on or off, calibrate sensors, and/or otherwise manipulate sensors. In some embodiments, the trainable transceiver 10 receives commands, instructions, data, and/or other information through one or more sensors. For example, the trainable transceiver 10 may receive voice commands from a user through the microphone. Continuing the example, data may be optically received using the light sensor. In some embodiments, the trainable transceiver 10 receives information (e.g., information input through physical interaction with the rear view mirror 70) through the accelerometer of the rear view mirror.

In some embodiments, the trainable transceiver 10 receives inputs from the operator input device 82 of the rear view mirror 70 (e.g., via the control circuit 72 of the rear view mirror 70 and/or the rear view mirror interface 36). The trainable transceiver 10 may send a control signal, instructions, information or otherwise communicate with the control circuit 72 of the rear view mirror 70 to cause inputs to be communicated to the trainable transceiver 10. The trainable transceiver 10 may use the operator input device 82 of the rear view mirror 70 to augment or replace the operator input device 20 associated with the trainable transceiver 10.

In some embodiments, the trainable transceiver 10 draws electrical power through a connection with the power source 84 included in the rear view mirror 70. As explained above, the power source 84 may provide power to the rear view mirror 70 from the electrical system of the vehicle and/or a battery. The trainable transceiver 10 may draw power from the power source 84 as well. For example, the trainable transceiver 10 may be connected to the power source 84 through the rear view mirror interface 36. Alternatively, components of the trainable transceiver 10 may draw power from direct connections to the power source 84. In other embodiments, the trainable transceiver 10 draws power from the control circuit 72 of the rear view mirror 70 which in turn draws power from the power source 84.

In one embodiment, the trainable transceiver 10 may use a transceiver included in the rear view mirror 70 and/or coupled to the rear view mirror 70 (e.g., a transceiver mounted in the vehicle) to send and/or receive activation signals, control signals, images, image data, and/or other information. For example, the trainable transceiver 10 may configure the transceiver and/or control circuit 72 of the rear view mirror 70 such that the trainable transceiver 10 has access to the internet, other networks, and/or networking hardware. In some embodiments, the trainable transceiver 10 may use a transceiver associated with the rear view mirror 70 to access other devices (e.g., home electronic devices, remote devices, mobile communications devices, networking devices, etc.).

Figure 2C:
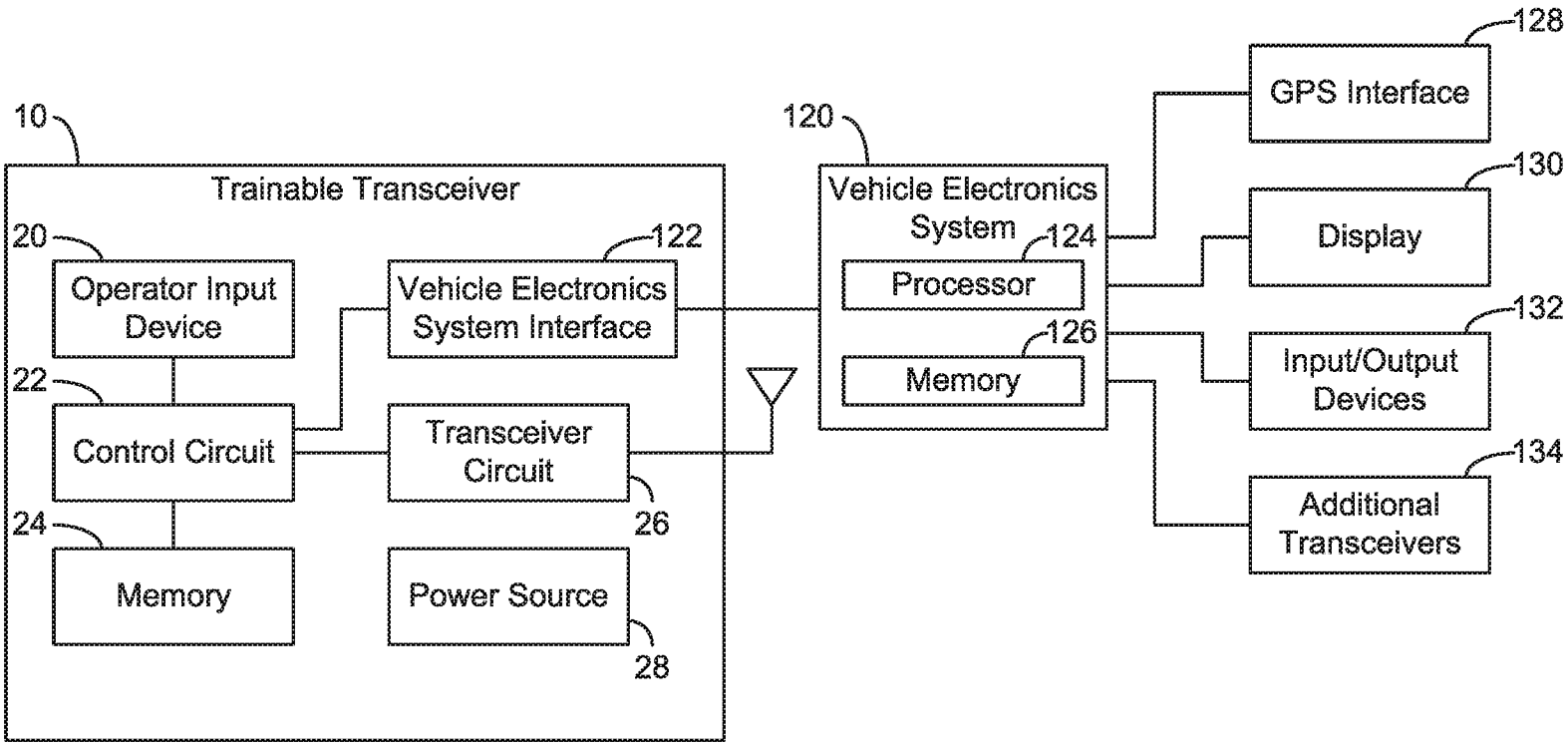
FIG. 2C illustrates an exemplary embodiment of a trainable transceiver connected to a vehicle electronics system.

Referring now to FIG. 2C, the trainable transceiver 10 is illustrated, according to an exemplary embodiment, including a connection to a vehicle electronics system 120. The connection to the vehicle electronics system 120 may be made using a vehicle electronics system interface 122 included in the trainable transceiver 10. In some embodiments, the vehicle electronics system interface 122 includes physical connection such as ports, connectors, wiring, and/or other hardware used to create an electrical connection between the control circuit 22 of the trainable transceiver 10 and the vehicle electronics system 120. In alternative embodiments, the control circuit 22 of the trainable transceiver 10 and the vehicle electronics system 120 are directly connected (e.g., wired such that outputs from one control circuit are received as inputs at the other control circuit and/or vice versa). In further embodiments, the vehicle electronics system interface 122 may include and/or be implemented by computer programing, code, instructions, or other software stored in memory 24 in the trainable transceiver 10 and/or rear view mirror. Advantageously, the connection between the trainable transceiver 10 and the vehicle electronics system 120 may allow for the trainable transceiver 10 to access, control, provide outputs to, receive inputs from, and/or otherwise communicate with components of the vehicle. The connection between the trainable transceiver 10 and the vehicle electronics system 120 may provide an advantage of allowing the trainable transceiver 10 to make use of existing vehicle hardware for use with functions of the trainable transceiver 10. Duplicative hardware may not be required thereby reducing cost and/or complexity of the trainable transceiver 10 by making use of existing hardware.

The vehicle electronics system may include processors 124 (e.g., electronic control units (ECU), engine control modules (ECM), or other vehicle processors), memory 126, buses (e.g., controller area network (CAN) bus, sensors, on-board diagnostics equipment (e.g., following the (OBD)-II standard or other protocol), cameras, displays, transceivers, infotainment systems, and/or other components integrated with a vehicle's electronics systems or otherwise networked (e.g., a controller area network of vehicle components). For example, the vehicle electronics system 120 may include, be coupled to, and/or otherwise communicate with a GPS interface 128. The GPS interface 128 may be configured to receive position information (e.g., from a GPS satellite source). Using the vehicle electronics system 120, vehicle electronics system interface 122, and/or control circuit 22, the trainable transceiver 10 may have access to position information from the GPS interface 128 (e.g., GPS coordinates corresponding to the current location of the vehicle).

Continuing the example, the vehicle electronics system 120 may include, be coupled to, and/or otherwise communicate with a display 130 of the vehicle. The display 130 may include or be a dashboard display, instrument panel display, infotainment display, rear view mirror display, rear seat display, and/or other displays in the vehicle. Using the vehicle electronics system 120, vehicle electronics system interface 122, and/or control circuit 22, the trainable transceiver 10 may have access to the display 130 of the vehicle. The trainable transceiver 10 may output images (e.g., using a frame buffer) to one or more displays 130 of the vehicle. The trainable transceiver 10 may output information related to training the trainable transceiver 10 (e.g., steps, procedures, instructions, current progress, etc.), information related to a home electronics device and/or remote device (e.g., status information, training information, identification information, etc.), diagnostic information, and/or other information accessible to the trainable transceiver 10 directly or through an intermediate device.

Continuing the example, the vehicle electronics system 120 may include, be coupled to, and/or otherwise communicate with input/output devices 132 of the vehicle. Input/output devices 132 may include hardware for receiving user input and providing output to a user. Input/output device 132 may include operator input devices, hardkey buttons, softkey buttons, touchscreens, microphones, speakers, displays, and/or other hardware. Using the vehicle electronics system 120, vehicle electronics system interface 122, and/or control circuit 22, the trainable transceiver 10 may receive inputs from and/or generate outputs using input/output devices 132 of the vehicle.

Continuing the example, the vehicle electronics system 120 may include, be coupled to, and/or otherwise communicate with additional transceivers 134 included in the vehicle. Additional transceivers may include NFC transceivers (e.g., used for pairing the mobile communications device 16 with an infotainment system), BLE transceivers (e.g., used for wireless communication between the mobile communications device 16 and an infotainment system), cellular transceivers (e.g., used for accessing the internet with the vehicle infotainment system and/or other hardware), radio transceivers (e.g., for FM radio, AM radio, high definition radio, satellite radio, etc.), and/or other transceivers. Using the vehicle electronics system 120, vehicle electronics system interface 122, and/or control circuit 22, the trainable transceiver 10 may receive information from, send information to, control, communicate, and/or otherwise interact with additional transceivers 134 of the vehicle. In some embodiments, the trainable transceiver 10 may use additional transceivers 134 of the vehicle to communicate with other devices such as home electronics devices, remote devices, and/or mobile devices. In further embodiments, the trainable transceiver 10 may use additional transceivers of the vehicle to access the internet, communicate with servers, access other networks, and/or otherwise communicate with network hardware.

Figure 3A:
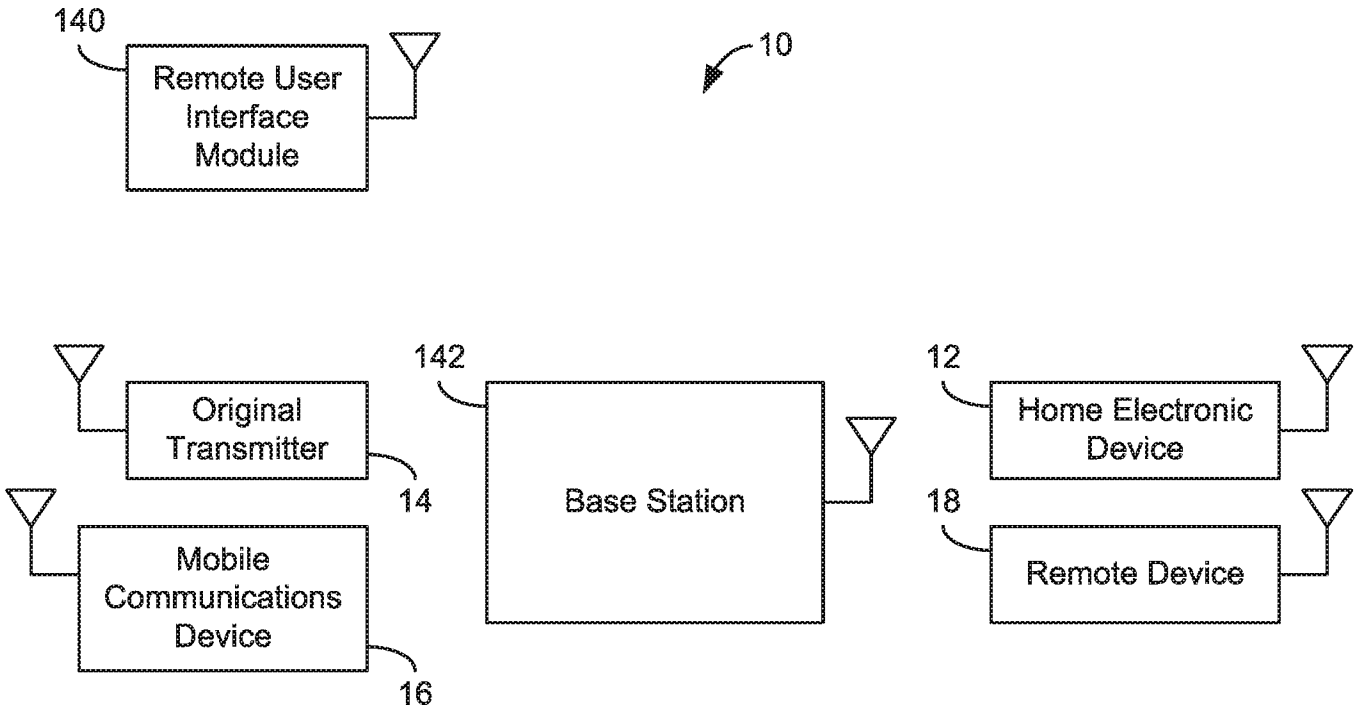
FIG. 3A illustrates an exemplary embodiment of a distributed trainable transceiver having a remote user interface module and a base station.
Figure 3B:
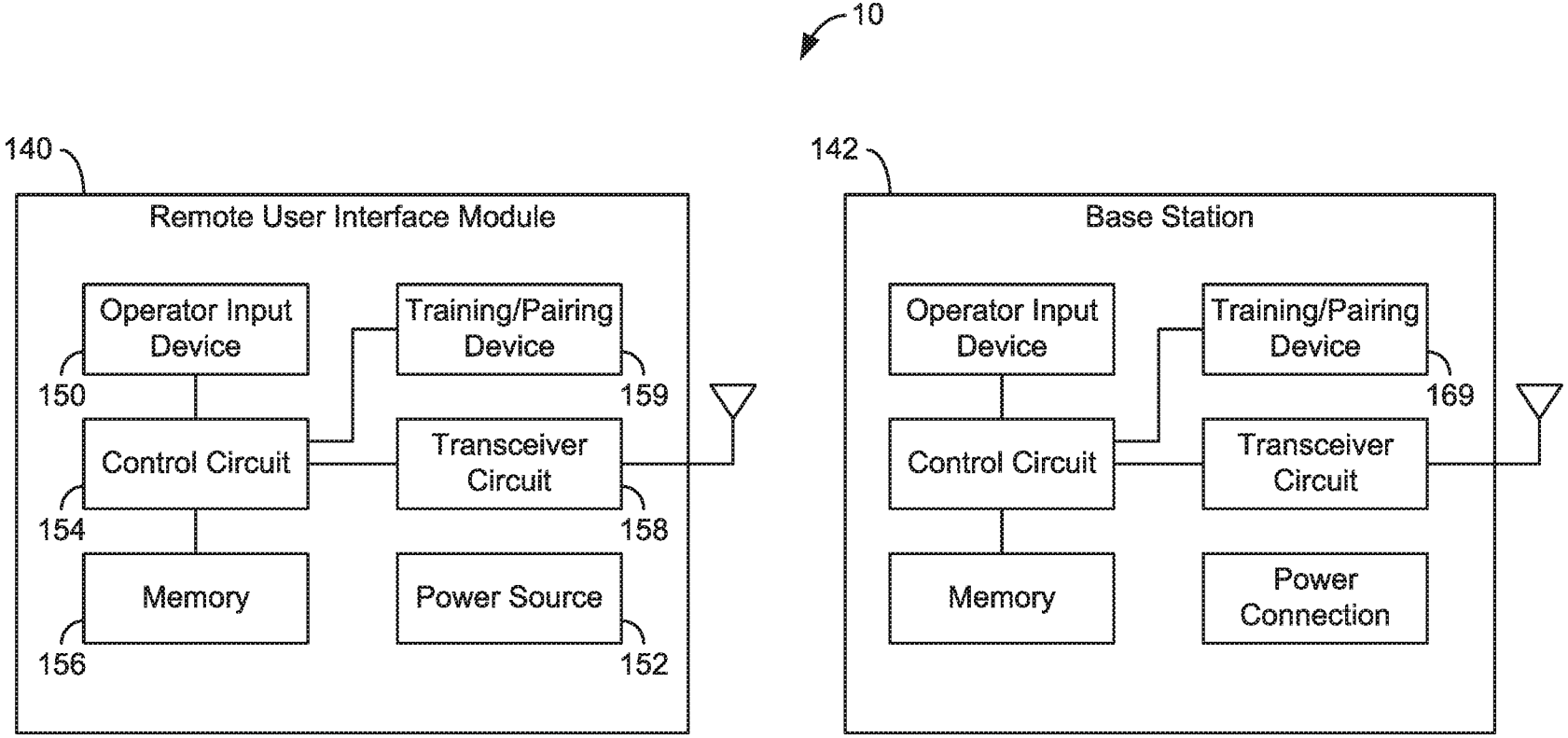
FIG. 3B illustrates the components which may be included in a remote user interface module and base station in one embodiment.

Referring now to FIGS. 3A and 3B, the trainable transceiver 10 may include two modules, a remote user interface module 140 and a base station 142. In one embodiment, the trainable transceiver 10 is a distributed system. The remote user interface module 140 may contain operator input devices 150, a power source 152, a control circuit 154, memory 156, output devices, and/or communications hardware. The remote user interface module 140 may communicate with the base station 142 located apart from the remote user interface module 140. For example, the remote user interface module 140 may include a transceiver circuit 158 used to communicate with the base station 142. The base station 142 may communicate with the remote user interface module using a transceiver circuit 168 and/or an additional transceiver such as those discussed above. The remote user interface module 140 may process user inputs and send information to the base station 142 with the transceiver circuit 158 configured to send an activation signal and/or other signal to another device. The transceiver circuit 168 in the base station 142 may be more powerful (e.g., longer range) than the transceiver circuit(s) 158 in the remote user interface module 140.

In some embodiments, the remote user interface module 140 may contain a transceiver configured to allow communication between the remote user interface module and another device such as a remote device 18 and/or mobile communications device 16. The remote user interface module 140 may serve as a communication bridge between the remote device 18 or mobile communications device 16 and another device such as the base station 142 or the home electronics device 12 or remote device in communication with the base station 142.

In other embodiments, the base station 142 may include a transceiver configured to allow communication between the remote user interface module 140 and another device such as the remote device 18 and/or mobile communications device 16. In some embodiments, the remote user interface module 140 includes a training/pairing device 159 and/or the base station 142 include a training/pairing device 169. The training/pairing devices 159 and 169 may be or include one or more transceivers (e.g., NFC transceiver, BLE transceiver, etc.), microphones, speakers, light sensors, light sources, and/or other hardware for communication between devices. The training/pairing devices 159 and 169 may allow for communication using one or more of the techniques described above with reference to FIGS. 2D-2D (e.g., BLE communication, NFC communication, light based communication, sound based communication, etc.). The training/pairing device 159 of the remote user interface module 140 may allow the remote user interface module 140 to communicate with the mobile communications device 16 and/or the base station 142. The training/pairing device 169 of the base station 142 may allow the base station 142 to communicate with the mobile communications device 16 and/or the remote user interface module 140. Communication may include pairing the mobile communications device 16 such that communications with the mobile communications device 16 are possible, pairing the remote user interface module 140 and the base station 142 such that communication between the two is possible, sending and/or receiving data, and/or other communication. In some embodiments, activation signal parameters, training information (e.g., device identification information), and/or other information related to the home electronics device 12 and/or remote device 18 are communicated between the mobile communications device 16 and the remote user interface module 140 and/or base station 142. In further embodiments, activation signal parameters, training information (e.g., device identification information), and/or other information related to the home electronics device 12 and/or remote device 18 are communicated between a remote user interface module 140 and base station 142. Communication may be unidirectional or bi-directional.

In some embodiments, the base station 142 is coupled to, connected to, and/or otherwise in communication with a system of the vehicle. For example, the base station 142 may be plugged into a power source of the vehicle such as a USB port, 12 volt power port, cigarette lighter, and/or other power source of the vehicle. In further embodiments, the base station 142 may be in communication with a vehicle electronics system. The remote user interface module 140 may be located within the vehicle remote from the base station 142. For example, the remote user interface module 140 may be coupled to a vehicle visor, rear view mirror, windshield, center counsel, and/or other vehicle component.

Referring generally to FIGS. 1-3B, the mobile communications device 16 includes an application configured to interact with the mobile communications device 16 and the trainable transceiver 10, in some embodiments. For example, the application may control a transceiver of the mobile communications device 16 for the function of communicating with the trainable transceiver 10. The application may facilitate communication between the mobile communications device 16 and the trainable transceiver 10, allow a user to configure or train the trainable transceiver 10, be used to acquire activation signal parameters stored locally (e.g., with the application in memory) and/or remotely (e.g., on a server accessible to the application using a connection to the internet provided by the mobile communications device 16), be used to transmit activation signal parameter to the trainable transceiver 10, and/or perform other functions described herein with respect to the mobile communications device 16 and/or trainable transceiver 10.

In some embodiments, the trainable transceiver 10 may access the internet using a communications connection with the mobile communications device 16. For example, the trainable transceiver 10 may transmit requests, control instructions, and/or other information to the mobile communications device causing the mobile communications device 16 to access information, send information, and/or otherwise retrieve information using an internet connection (e.g., through a cellular transceiver and/or other transceiver). The mobile communications device 16 may transmit the resulting information and/or data to the trainable transceiver 10. The mobile communications device 16 may serve as intermediary device which is used by the trainable transceiver 10 to communicate with other devices (e.g., servers, networking equipment, other mobile communications device, home electronics devices, remote devices, and/or other devices). In some embodiments, the trainable transceiver 10 may use the mobile communications device 16 to retrieve activation signal parameters, training information (e.g., device identification information), and/or other information related to the home electronics device 12 and/or remote device 18.

In some embodiments, the trainable transceiver 10 may communicate with other devices (e.g., mobile communications devices, home electronics devices, remote devices, network hardware, and/or other devices) using other techniques. These techniques may be used in addition to or in place of those previously described. For example, short message service (SMS) messages, internet communication protocols, inductive coupling, mini access point protocols (e.g., a device may be or include a mini access point that allows communication without requiring a connection to the internet, web based interfaces, and/or other communications techniques may be used.

In some embodiments, free-space optical communication techniques and/or techniques in which data is encoded onto light emitted by a light source through modulation of the light source (e.g., frequency modulation, amplitude modulation, etc.) may be used for wireless communications between one or more of the devices illustrated in FIG. 1. For example, the devices may include light sources such as light emitting diodes and light sensors (e.g., a camera, photodector) used to generate light based signals and to receive light based signals. This and/or other hardware (e.g., control circuit) or software may allow two or more devices to communicate using light. In other embodiments, two or more of the devices illustrated in FIG. 1 communicate using sound based communication. For example, a modulated sound wave technique, technique based on the frequency, wavelength, amplitude, Decibel, and/or other parameters of the sound wave(s), protocol (e.g., fax protocol), and/or other technique may be used to communicate using sound waves. The sound waves may be in the ultrasound frequency spectrum, acoustic (e.g., audible) spectrum, infrasound spectrum, and/or other spectrum. The devices may include hardware and/or software used in communicating with sound such as control circuits, speakers, microphones, and/or other hardware and/or software used to facilitate sound based communication. In further embodiments, other types of communication may be used. For example, two devices may communicate by exchanging machine readable images containing encoded information (e.g., a display of a first device displays a machine readable image read by a camera of a second device an decoded using a control circuit), by exchanging text messages, by exchanging e-mails, and/or using other types of communication.

Referring generally to FIGS. 1-3B, the trainable transceiver 10 may perform one or more auxiliary functions using one or more of the communication methods described above and/or one or more additional devices (e.g., the mobile communications device 16) or hardware (e.g., networking hardware). Auxiliary functions may be performed in addition to or in place of functions associated with controlling the home electronics device 12, remote device 18, and/or other device (e.g., sending activation signals formatted to control a device, receiving status information from a device, communicating with a device, etc.).

Figure 4A:
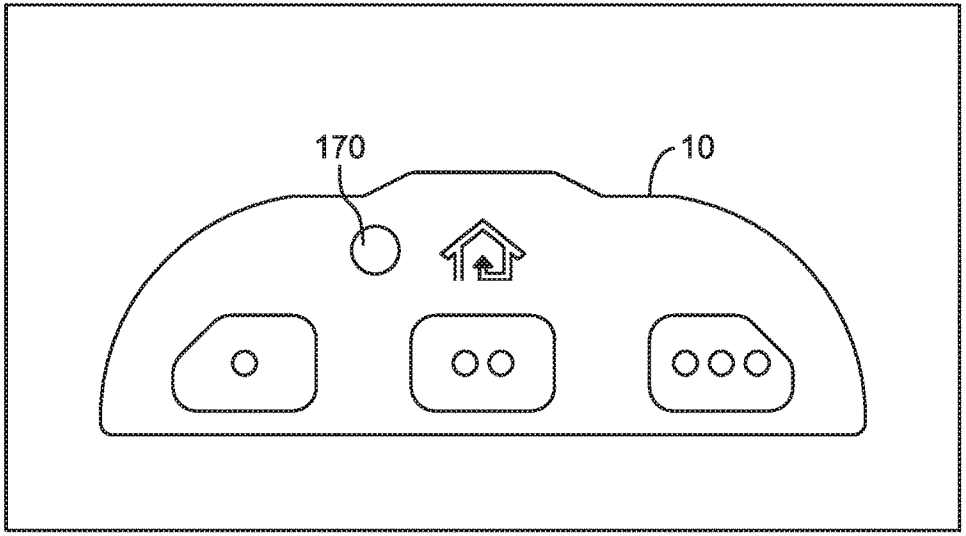
FIG. 4A illustrates an exemplary embodiment of a trainable transceiver including an indicator light.

Referring now to FIG. 4A, the trainable transceiver 10 includes an indicator light 170 in some embodiments. The trainable transceiver 10 may be in communication with the mobile communications device 16 using one or more of the communication techniques described herein (e.g., using a BLE transceiver 64 of the mobile communications device 16 and the BLE transceiver 32 of the trainable transceiver 10). The mobile communications device 16 may provide the trainable transceiver 10 with information related to the mobile communications device 10 (e.g., phone calls, messages, notifications, and/or other information associated with the mobile communications device and/or an application running thereon). In response to information received from the mobile communications device 16, the trainable transceiver 10 may illuminate the indicator light 172 (e.g., by processing information received from the mobile communications device 16 using the control circuit 22 of the trainable transceiver 10 and illuminating the indicator light 172 in response to the control circuit 22). The indicator light 172 may be an output device of the trainable transceiver 10, rear view mirror 70, and/or vehicle electronics system and may include hardware such as LED lights, displays, speakers (e.g., the trainable transceiver 10 may produce a noise to indicate a received message), etc. For example, if the mobile communications device 16 receives a SMS message, text message, e-mail, phone call, voice mail, and/or other communication (e.g., using an internet connection, cellular transceiver, etc.), the mobile communications device 16 may communicate this status to the trainable transceiver 10 (e.g., using a Bluetooth protocol). In response, the trainable transceiver 10 may process the communication and illuminate the indicator light 172 (e.g., using the control circuit). Advantageously, a vehicle occupant can be made aware of a communication received by the mobile communications device 16 without having to look at the mobile communications device 16. For example, the indicator light 172 may be part of the rear view mirror 70 which the vehicle occupant looks at while driving the vehicle. This provides an advantage in that the vehicle occupant can view the status of the mobile communications device 16 (e.g., that a message has been received) without altering the diver's normal driving routine (e.g., checking the rear view mirror 70) to look at the mobile communications device 16.

Figure 4B:
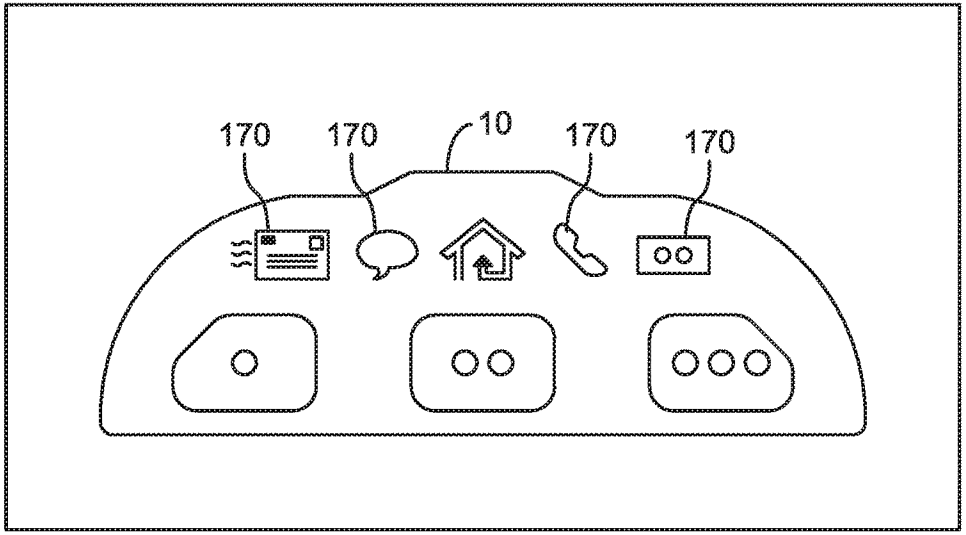
FIG. 4B illustrates an exemplary embodiment of a trainable transceiver including a plurality of indicator lights associated with icons.
Figure 4C:
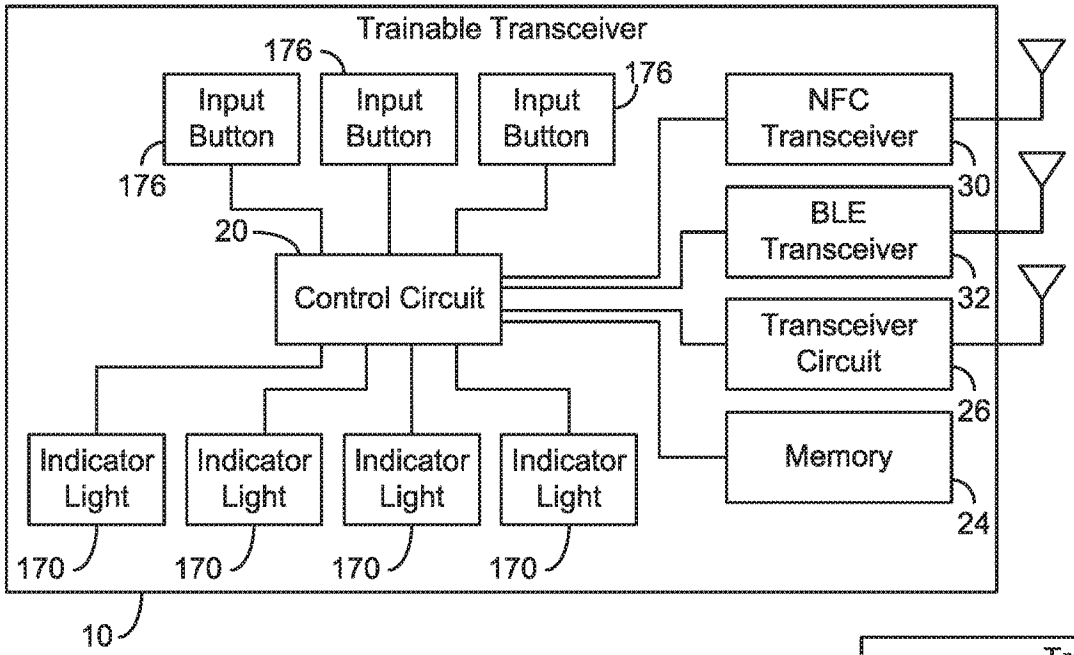
FIG. 4C illustrates an exemplary embodiment of hardware components of a trainable transceiver including a plurality of the indicator lights.
Figure 4D:
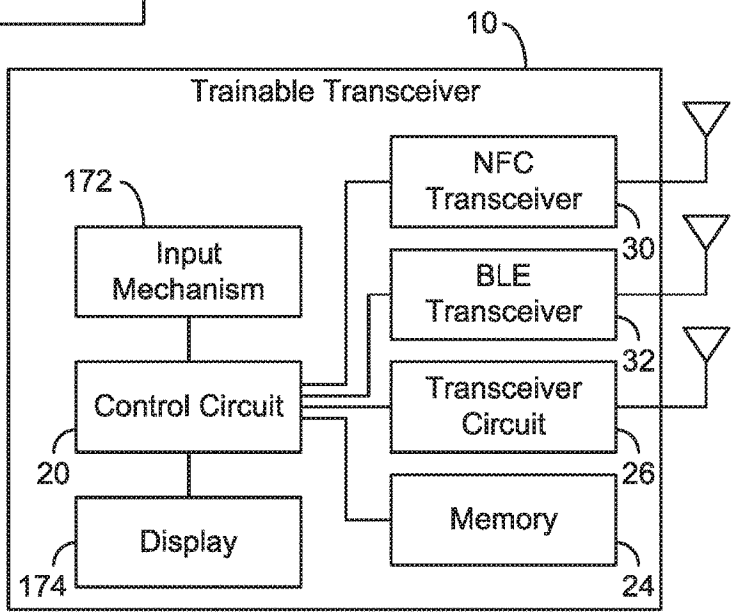
FIG. 4D illustrates an exemplary embodiment of hardware components of a trainable transceiver including an input mechanism.

Referring now to FIGS. 4B-4C, the trainable transceiver may include a plurality of indicator lights 170. For example, each indicator light 170 may correspond to a particular communication which may be received by the mobile communications device. As depicted in FIG. 4B an indicator light 170 may correspond to an e-mail, text message, phone call, and voicemail received by the mobile communications device 16. Upon receiving a communication, the mobile communications device 16 may communicate information about the communication to the trainable transceiver 10. For example, the mobile communications device 16 may communicate, to the trainable transceiver 10, information identifying the type of communication received by the mobile communications device 16. The trainable transceiver 10 may in turn use this information to illuminate a corresponding indicator light 170. Advantageously, the trainable transceiver 10 may provide a vehicle occupant with information as to the type of communication received as well as the information that a communication has been received.

In some embodiments, the mobile communications device 16 may provide more detailed information to the trainable transceiver 10. For example, the mobile communications device 16 may provide an image (e.g., a frame buffer) corresponding to message text, an application icon corresponding to a received communication, and/or other information. Using a display included in the trainable transceiver 10 and/or accessible to the trainable transceiver 10 (e.g., a display in an integrated rear view mirror system), the trainable transceiver 10 may display the more detailed information to a vehicle occupant. For example, the trainable transceiver 10 (e.g., using the control circuit 22 to receive information from the mobile communications device 16, process the information, control a display, etc.) may display to the vehicle occupant information corresponding to the communications received by the mobile communications device 16. As discussed above, the indicator light 172 and/or other hardware used to relay information received by the mobile communications device 16 to a vehicle occupant using the trainable transceiver 10 may be or include a display of the trainable transceiver 10, display of a rear view mirror 70, display of a vehicle electronics system (e.g., infotainment system), and/or other hardware configured to provide an output to a vehicle occupant.

Referring now to FIGS. 4D-9, the trainable transceiver 10 may provide inputs to the mobile communications device 16 to control one or more features of the mobile communications device 16 and/or applications running on the mobile communications device 16. In some embodiments, the trainable transceiver 10 includes an input mechanism 172 and/or operator input device 20 as discussed above. The input mechanism 172 and/or operator input device 20 may serve two functions. For example, the input mechanism 172 may be used to provide inputs which control functions and/or features of the trainable transceiver 10 described herein (e.g., sending an activation signal), and the input mechanism 172 may be used to provide inputs which control functions and/or features of the mobile communications device 16. The trainable transceiver 10 may arbitrate between inputs (e.g., using the control circuit 22, memory 24, and/or other hardware) to determine if an input controls the trainable transceiver 10 and/or the mobile communications device 16. The trainable transceiver 10 may arbitrate between inputs using one or more factors such as inputs selecting which function the user wishes to control (e.g., a button to switch between functions), what function the previous input, output, or other action was related to, geographic proximity to a device controlled by the functions of the trainable transceiver 10, and/or other factors. In other embodiments, the operator input device 20 and/or input mechanism 172 may include hardware dedicated to receiving user inputs form controlling functions of the trainable transceiver 10 and a second set of hardware dedicated to receiving using inputs form controlling functions related to the mobile communications device 16.

In some embodiments, the input mechanism 172 and/or operator input device 20 is or includes hard key buttons, softkey buttons, a touchscreen display, microphone (e.g., using voice commands), and/or other hardware configured to accept user inputs. In some embodiments, the input received by the operator input device 172 and/or input mechanism 20 may be interpreted by the control circuit 22 and/or memory 24 of the trainable transceiver 10. For example, a user may press a button of the trainable transceiver 10. The control circuit 22 may determine that this button corresponds to a command to place a call to a particular contact located in a phonebook of the mobile communications device 16. The control circuit 22 may communicate information, instructions, a control signal, and/or other data to the mobile communications device 16 (e.g., using a BLE transceiver) configured to cause the mobile communications device 16 to place the call. The mobile communications device 16 may receive the communication from the trainable transceiver 10 and take a corresponding action (e.g., placing a call to a particular contact). In some embodiments, the trainable transceiver 10 may cause the mobile communications device 16 to take one or more of a variety of actions. These actions may include placing a call, sending a message, dismissing a notification, updating a status, and/or otherwise using the mobile communications device 16 and/or an application running thereon to take an action.

In some embodiments, the trainable transceiver 10 is customizable such that a user may select a particular function related to the mobile communications device 16 which the trainable transceiver 10 and mobile communications device 16 carry out in response to a particular input (e.g., pushing a particular button of the trainable transceiver 10). In one embodiment, the functions of the input mechanism 172 may be assigned using input mechanisms and/or operator input devices of the trainable transceiver 10. For example, a user may select from a list of available functions to associate with a particular button using buttons of the trainable transceiver 10 (e.g., input buttons 176, illustrated in FIG. 4C) and a display 174 associated with the trainable transceiver 10. The mobile communications device 16 may be in communication with the trainable transceiver 10, such that the trainable transceiver 10 provides a list of assignable functions based on information from the mobile communications device 16. For example, the mobile communications device 16 may provide a list of functions for which the mobile communications device 16 may receive commands which control the functions (e.g., placing a phone call, sending a message, etc.). In other embodiments, the trainable transceiver 10 and functions for controlling the mobile communications device 16 may be configured using the mobile communications device 16 in communication with the trainable transceiver 10 and/or an application running on the mobile communications device 16. For example, a user may use an application on the mobile communications device 16 to assign functions of the mobile communications device 16 to particular trainable transceiver inputs which when selected carry out the assigned function. The mobile communications device 16 and/or the application may communicate this configuration information to the trainable transceiver 10. The trainable transceiver 10 may in turn be configured by and/or use this information to configure itself to control functions of the mobile communications device 16. In further embodiments, hardware associated with the vehicle electronic system (e.g., an infotainment system) may be used in conjunction with or in place of one or more of the configuration techniques described above.

Using one or more of the above described techniques, the buttons 176 of the trainable transceiver 10 may be used to control one or more functions of a mobile communications device 16. In this way, buttons 176 of the trainable transceiver 10 may act as hot keys (e.g., shortcut keys) which when pressed cause the mobile communications device 16 to perform a particular function. Advantageously, this may allow a user to control the mobile communications device 16 without taking his or her eyes of the road (e.g., the trainable transceiver 10 is integrated with a rear view mirror 70). This configuration may also provide an advantage in that the vehicle occupant need not have access to the mobile communications device 16 in order to control the mobile communications device 16. For example, the mobile communications device 16 may be in a pocket or handbag of the vehicle occupant (e.g., driver). It may be inconvenient and/or dangerous for a vehicle occupant to access the mobile communication device 16 while driving, but it may be more convenient and/or safer to control the mobile communications device 16 using a hot key of the trainable transceiver 10.

Figure 5:
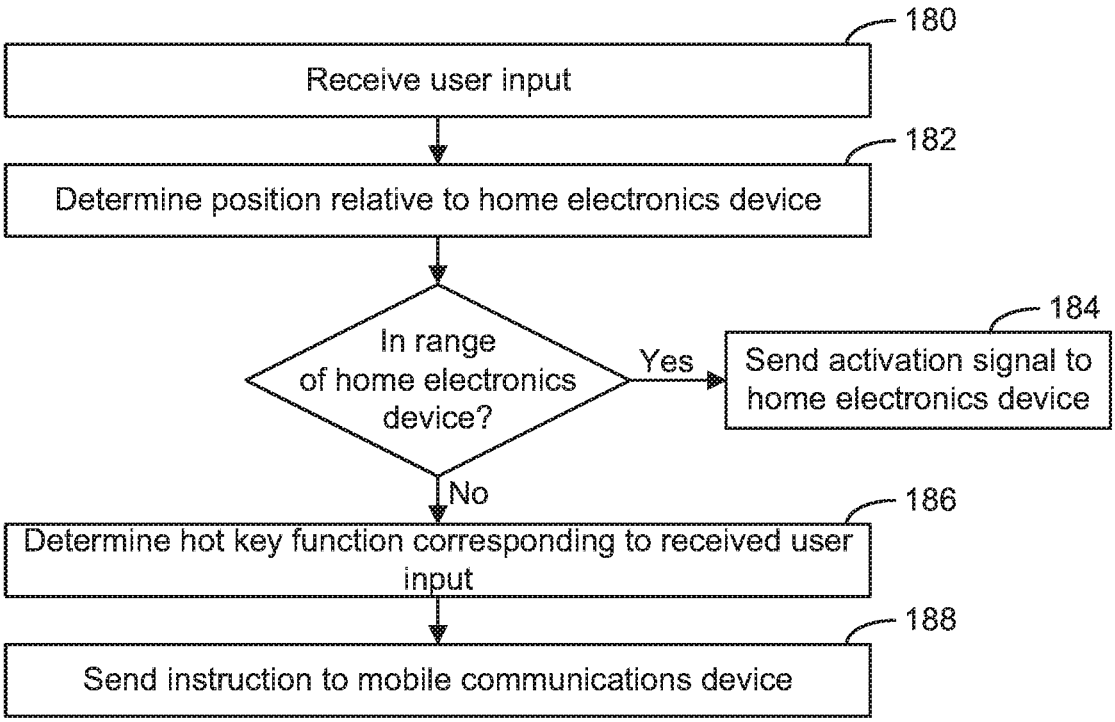
FIG. 5 illustrates a flow chart for determining which of a plurality of functions a trainable transceiver will perform in response to user input and based on the location of the trainable transceiver according to an exemplary embodiment.

Referring now to FIG. 5, the trainable transceiver 10 may determine whether an input controls functions of the trainable transceiver 10 or functions of the mobile communications device 16 based on the location of the trainable transceiver 10 in relationship to one or more of the devices the trainable transceiver 10 is trained to control. The trainable transceiver 10 may receive position information from one or more of the sources previously described. For example, the current position of the trainable transceiver 10 may be determined using a GPS device included in the trainable transceiver 10, a GPS device accessible by the trainable transceiver 10, dead reckoning techniques, etc. The position of devices which the trainable transceiver 10 is configured to control may be determined using one or more of the techniques previously described. For example, the location of the device may be stored in memory based on GPS position information retrieved during the training process. In other embodiments, the trainable transceiver 10 may determine its position relative to more or more devices based on the signal range of the transceiver circuit. For example, the trainable transceiver 10 may send a signal to the home electronics device 12. If the home electronics device 12 does not send an acknowledgement signal, the trainable transceiver 10 may determine that is not in signal range of the home electronics device 12. Conversely, if an acknowledgement signal is received, the trainable transceiver 10 may determine that it is within signal range of the device.

The flow chart illustrated in FIG. 5 illustrated one embodiment of a flow chart describing the logical process carried out by the trainable transceiver 10 to determine the appropriate function to be controlled by the trainable transceiver 10. The trainable transceiver 10 may receive a user input (step 180). For example, the user input may be a button press. The trainable transceiver 10 may then determine its position relative to the home electronics device 12 and/or other device which the trainable transceiver 10 is programmed to control (e.g., by sending an activation signal) in response to the user input (e.g., the button press) (step 182). If the trainable transceiver 10 determines that it is within range of the home electronics device 12 and/or other device associated with the user input (e.g., using position information and/or the reception of an acknowledgement signal), the trainable transceiver 10 may send an activation signal to the home electronics device 12 and/or other device (step 184). For example, the trainable transceiver 10 may send an activation signal to the home electronics devices 12 associated with the button the user has pressed.

If the trainable transceiver 10 determines that it is not in range of the home electronics device 12 and/or other device associated with the button (e.g., using position information), the trainable transceiver 10 may determine the hot key function corresponding to the user input device (step 186). For example, the control circuit 22 may read memory 24 in order to determine which function of the mobile communications device 16 is associated with the particular button pressed by the user. The trainable transceiver 10 may then send an instruction and/or other information to the mobile electronics device 16 in order to carry out the function associated with the user input received (step 188). For example, the trainable transceiver 10 may determine that the button pressed corresponds to placing a call to a particular contact in the phonebook of the mobile communications device 16. The trainable transceiver 10 may send an instruction to the mobile communications device 16 (e.g., using a Bluetooth protocol) which the mobile communication device 16 carries out (e.g., the mobile communications device 16 places the call).

Referring now to FIGS. 6A-7B, the mobile electronics device 16 may function as a key for the trainable transceiver 10 in some embodiments. The trainable transceiver 10 may be configured such that no activation signals are sent unless the trainable transceiver 10 receives information from the mobile communications device 16. The information received from the mobile communications device 16 may be a unique key which, when received by the trainable transceiver 10, allows the trainable transceiver 10 to function. Other cryptographic techniques may be used such that the trainable transceiver 10 does not function unless in communication with the or a particular mobile communications device.

Figure 6B:
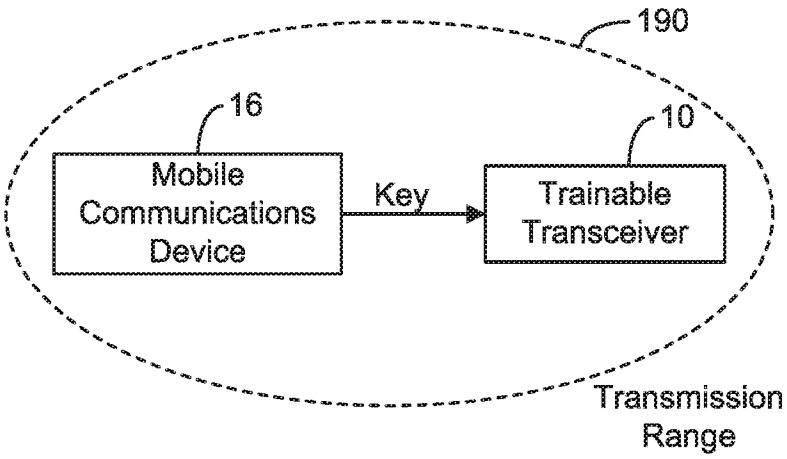
FIG. 6B illustrates an exemplary embodiment of a mobile communications device functioning as a key to allow use of the trainable transceiver where the trainable transceiver is within transmission range of the mobile communications device.
Figure 6A:
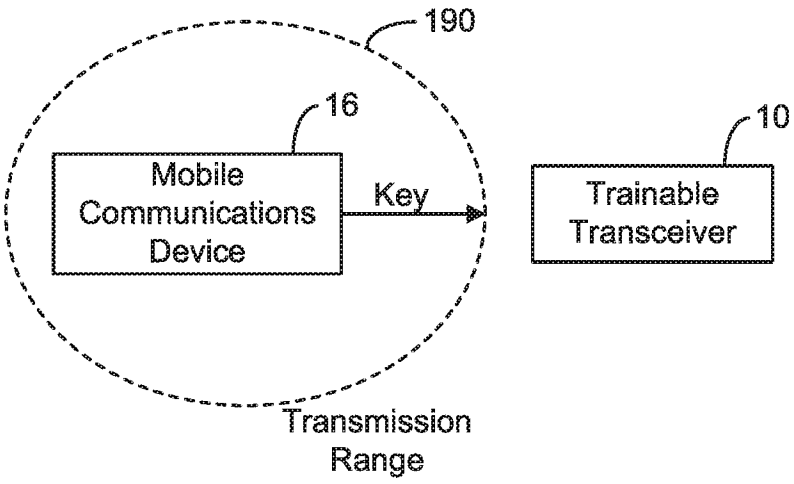
FIG. 6A illustrates an exemplary embodiment of a mobile communications device functioning as a key to allow use of the trainable transceiver where the trainable transceiver is not within transmission range of the mobile communications device.

Referring now to FIGS. 6A-6B, the mobile communications device 16 and/or an application running on the mobile communications device 16 transmit a key (e.g., data and/or information which when received by the trainable transceiver 10 allows the trainable transceiver 10 to send activation signals and/or otherwise communicate with devices). The mobile communications device 16 may transmit the key continuously, intermittently, when the mobile communications device 16 is paired with the trainable transceiver 10, and/or in response to a user input provided through an input mechanism associated with the mobile communications device 16 (e.g., a touchscreen).

Referring to FIG. 6A, the trainable transceiver 10 will not send activation signals in response to user input if the key has not been received by the trainable transceiver 10 in some embodiments. The trainable transceiver 10 may check to see if the key has been received every time a user provides an input, at a certain time interval since the key was last received (e.g., 10 minutes since the key was received), continuously, and/or at other times or using other techniques. In some embodiments, if the trainable transceiver 10 is outside the transmission range 190 of signal from the mobile communications device 16 (e.g., outside the range of the BLE transceiver 64 included in the mobile communications device 16), the trainable transceiver 10 will not send activation signals in response to user inputs as the trainable transceiver 10 is unable to receive a key from the mobile communications device 16.

Referring now to FIG. 6B, when the trainable transceiver 10 is within the transmission range 190 of the mobile communications device 16, the trainable transceiver 10 may receive the key from the mobile communications device 16. For example, the mobile communications device 16 may be continuously transmitting the key, and the trainable transceiver 10 may receive the key once it is within the transmission range 190 of the mobile communications device 16. Alternatively, the mobile communications device 16 may pair with the trainable transceiver 10 once the trainable transceiver 10 is within the transmission range 190 of the mobile communications device 16 (e.g., using a Bluetooth protocol). Upon the trainable transceiver 10 paring with the mobile communications device 16, the mobile communications device 16 may send the key to the trainable transceiver 10. The trainable transceiver 16 may then send activation signals in response to user input received by the trainable transceiver 10.

In some embodiments, other functions of the trainable transceiver 10 may be disabled when no key has been received. For example, a user may be prevented from training the trainable transceiver 10 when the trainable transceiver 10 has not received the key. In some embodiments, the trainable transceiver 10 includes a database of keys which when transmitted to the trainable transceiver 10 allow the trainable transceiver 10 to function. A key may be transmitted to a mobile communications device 16 for later use when the mobile communications device 16 is first paired to the trainable transceiver 10. In some embodiments, multi factor security may be used when the mobile communications device 16 is given the key. For example, the mobile communications device 16 may be required to pair with the trainable transceiver 10 using NFC ensuring that the user has physical access to the trainable transceiver 10. Additionally, the key may be transmitted by e-mail and/or a user may be required to authenticate the mobile communications device 16 in response to an e-mail triggered by the pairing process. Other encryption techniques may be used to provide the mobile communications device with the key. Furthermore, the key may be implemented by one or more encryption techniques. For example, the key may be a rolling code, fixed code, encrypted, and/or otherwise be implemented with an encryption technique.

In one embodiment, the trainable transceiver 10 attempts to receive the key at start up. For example, a transceiver of the trainable transceiver 10 may be set to listen for a mobile communications device 16 at a specific frequency (e.g., 915 MHz). If the key is not received at startup (e.g., or within a certain time period of the trainable transceiver 10 starting up such as 3 minutes), the trainable transceiver 10 will not send activation signals in response to user inputs and/or other features of the trainable transceiver 10 may be disabled. In other embodiments, the trainable transceiver 10 may listen for the key at multiple frequencies and/or using multiple communications protocols. The mobile communications device 16 functioning as the key may be dedicated and/or have other functions. For example, a smartphone may function as the key. In further example, a dongle attached to the smartphone or a key fob may function as the key.

Figure 7B:
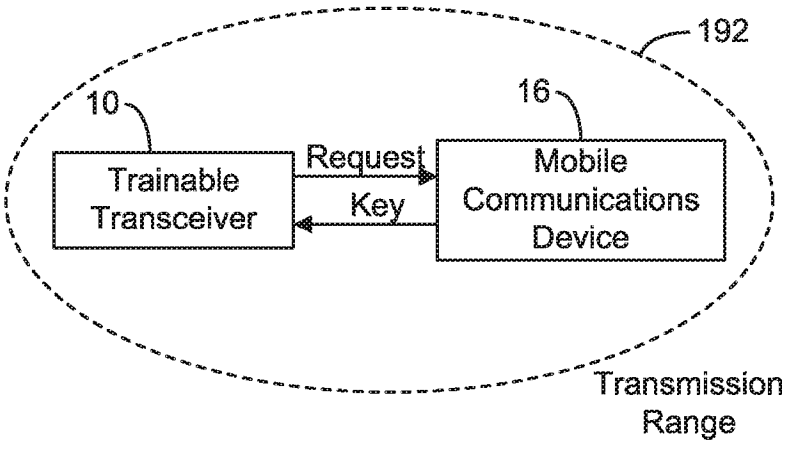
FIG. 7B illustrates an exemplary embodiment of a trainable transceiver transmitting a request for a key from a mobile communications device wherein the mobile communications device is within transmission range of the trainable transceiver.
Figure 7A:
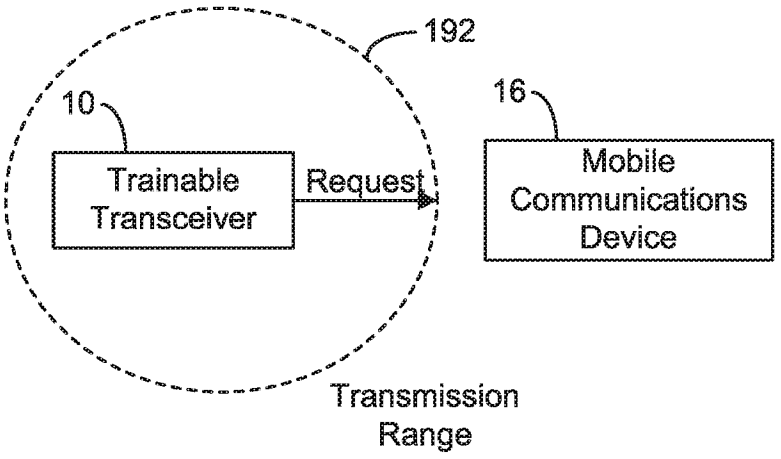
FIG. 7A illustrates an exemplary embodiment of a trainable transceiver transmitting a request for a key from a mobile communications device wherein the mobile communications device is not within transmission range of the trainable transceiver.

Referring now to FIGS. 7A-7B, the trainable transceiver 10 may send a request for the key in some embodiments. The trainable transceiver 10 may send a transmission to the mobile communications device 16 (e.g., one paired with the trainable transceiver 10) requesting the key from the mobile communications device 16. In some embodiments, the trainable transceiver 10 may send a key request transmission after failing to receive a key in response to the first key request transmission. In one embodiment, the trainable transceiver 10 sends a key request transmission periodically. In other embodiments, the trainable transceiver 10 sends a key request transmission upon the occurrence of a triggering event. For example, the triggering event may be and/or include powering on the trainable transceiver 10, pairing with the mobile communications device 16, receiving a user input corresponding to sending an activation signal, detecting that the trainable transceiver 10 is within communications range of the home electronics device 12 or other device, and/or other events. In further embodiments, the mobile communications device 16 may be configured to push a key to the trainable transceiver 10 without first receiving a request for the key. For example, a user may provide an input through an application on the mobile communications device 16 which pushes the key to the trainable transceiver 10. One or more of the above described techniques may be used in combination.

Referring now to FIG. 7A, if the key is not received, the trainable transceiver 10 may disable one or more functions (e.g., sending activation signals). For example, a key may not be received in response to a request transmission because the mobile communications device 16 having the key is outside of the transmission range 192 of the trainable transceiver 10 (e.g., outside the transmission range of the BLE transceiver 32 used by the trainable transceiver 10 to communicate with mobile communications devices).

Referring now to FIG. 7B, upon receiving a request for the key, the mobile communications device 16 may transmit the key to the trainable transceiver 10. Upon receiving the key, the trainable transceiver 10 may determine (e.g., using the control circuit 22 and memory 24) that the key allows the trainable transceiver 10 to perform one or more functions (e.g., sending activation signals). For example, the trainable transceiver may 10 check the received key against a key saved in memory 24 of the trainable transceiver 10. Upon determining that the key is a correct key, the trainable transceiver 10 may enable one or more functions (e.g., sending an activation signal).

Advantageously, the functions described above with reference to FIGS. 6A-7B provide for secured use of the trainable transceiver 10. The trainable transceiver 10 may prevent unauthorized use of the trainable transceiver 10 by requiring a key from a user stored on the mobile communications device 16. In some embodiments, the features described above with respect to requiring a key may be used in combination with other features, functions, and/or applications described herein. For example, the key may be used to allow the mobile communications device 16 to work with a plurality of vehicles and trainable transceivers with the mobile communications device 16 knowing which vehicle's trainable transceiver it is connected to. For example, the key may be unique to each trainable transceiver. This may allow the mobile communications device 16 to configure each trainable transceiver based upon the vehicle in which the trainable transceiver is located and/or perform other functions discussed with reference to FIGS. 5-7B.

Referring generally to FIGS. 4A-7B, the techniques described in reference to FIGS. 4A-7B may be used to provide a notification to a user that the trainable transceiver 10 is within transmission range of the home electronics device 12, remote device 18, and/or other device which the trainable transceiver 10 is trained to control. Upon determining that the trainable transceiver 10 is within transmission range of a device, the trainable transceiver 10 may provide a notification to a user and/or vehicle occupant as described with reference to FIGS. 4A-4C. For example, an indicator light corresponding to the device may be illuminated, information may be displayed on a display of the trainable transceiver 10, rear view mirror 70, and/or vehicle infotainment system, a speaker may be used to output an audible notification, an instruction may be sent to the mobile communications device 16 to cause the device to vibrate, etc. In some embodiments, a light source is illuminated corresponding to the button which sends an activation signal corresponding to the device which is in range. For example, each of three buttons may be configured to send an activation signal to a different device. As each device comes within the transmission range 192 as determined by the trainable transceiver 10, a backlight behind the button and/or a light incorporated into the button may be illuminated for the button corresponding to the device coming within the transmission range 192 of the trainable transceiver 10 (e.g., the transceiver circuit). The light may remain illuminated until the trainable transceiver 10 is powered off (e.g., the vehicle is turned off), until a predetermined amount of time has passed (e.g., 10 minutes), the button is pressed, the device exits the transmission range 192 of the trainable transceiver 10, and/or another event occurs. In further embodiments, a backlight of the trainable transceiver 10 may be illuminated a particular color when one or all of the devices are within transmission range. For example, the backlight color may change from orange to green. In further embodiments, the backlight is illuminated when one or all of the devices are within transmission range 10. In embodiments of the trainable transceiver 10 using one or more profiles as described with reference to FIG. 5, the above techniques may be used with respect to the active profile and/or the device for which the trainable transceiver 10 is currently trained to control. Alternatively or additionally, the trainable transceiver 10 may determine which set of device for which to apply the above described notification techniques based on the location of the trainable transceiver 10. For example, the trainable transceiver 10 may produce notifications based on the transmission range 192 of the trainable transceiver 10 in relationship to the group (e.g., profile) of devices which the trainable transceiver 10 is closest to as determined using GPS data and/or other positioning data.

The trainable transceiver 10 may determine that a device is within the transmission range 192 of the trainable transceiver 10 using one or more of the techniques described with reference to FIG. 5. For example, the trainable transceiver 10 may determine that a device is within the transmission range 192 based on location and/or position data corresponding to the location of the device and location and/or position data corresponding to the current location of the trainable transceiver 10. The position data corresponding to the current location of the trainable transceiver 10 may come from dead reckoning, cellular triangular, a GPS sensor in communication with the trainable transceiver 10 (e.g., included in the trainable transceiver, included in the mobile communications device 16 paired to the trainable transceiver 10, included in the vehicle, etc.), and/or using any technique described with reference to FIG. 5. Similarly, position and/or location data corresponding to a device may be provided using one or more of the techniques described with reference to FIG. 5. For example, the position information may be based on GPS coordinates stored in memory when the trainable transceiver 10 was trained to control the device, based on an address provided by a user corresponding to the location of the device, and/or other techniques described with reference to FIG. 5.

In some embodiments, the trainable transceiver 10 may determine if a device is the within transmission range 192 using two-way (e.g., bidirectional) communication with the device as described with reference to FIG. 5. For example, the trainable transceiver 10 may send out a request transmission to the device, continuously, periodically, and/or based on the location of the trainable transceiver 10 relative to the device. If the trainable transceiver 10 receives a transmission from the device in response to the request transmission, the trainable transceiver 10 may determine that the device is within the transmission range 192 of the trainable transceiver 10.

Figure 8A:
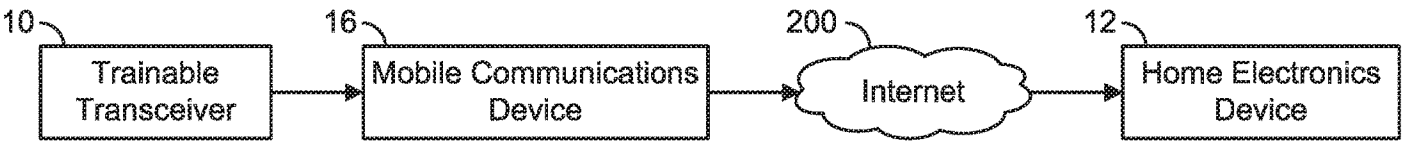
FIG. 8A illustrates an exemplary embodiment of a trainable transceiver configured to control a device using the internet.
Figure 8B:
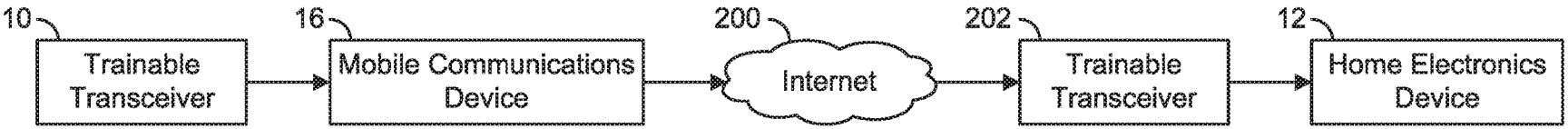
FIG. 8B illustrates an exemplary embodiment of a trainable transceiver configured to control a device using the internet and a second trainable transceiver.

Referring now to FIGS. 8A-8B, the mobile communications device with an internet connection may be used to extend the range of a trainable transceiver in some embodiments. It may be advantageous to extend the range of the trainable transceiver 10 beyond the range of the transceiver circuit 26 included in the trainable transceiver 10. This may allow the trainable transceiver 10 to send activation signals to home electronics devices, remote devices, and/or other devices at a greater distance. Similarly, extending the range of the trainable transceiver 10 may allow bidirectional communication between the trainable transceiver 10 and home electronics devices, remote devices, and/or other devices at a greater range. For example, the home electronics device 12 may transmit status information to the trainable transceiver 10 which the trainable transceiver 10 may process and/or output to a vehicle occupant.

In one embodiment, the trainable transceiver 10 connects to the internet using a transceiver included in the trainable transceiver 10. For example, the trainable transceiver 10 may include a cellular transceiver which allows the trainable transceiver 10 to connect to the internet. In other embodiments, the trainable transceiver 10 may connect to the internet via one or more vehicle electronics systems. For example, the vehicle may include a cellular transceiver which the trainable transceiver 10 is configured to control (e.g., using the control circuit 22). In further embodiments, the trainable transceiver 10 connects to the internet via the mobile communications device 16 and/or application running thereon. For example, the trainable transceiver 16 may transmit instructions and/or other information to the mobile communications device 16 (e.g., using a Bluetooth protocol and/or BLE transceiver). The mobile communications device 16 may receive the instructions and/or information and access the internet using a cellular transceiver included in the mobile communications device 16.

Referring now to FIG. 8A, the connection to the internet (e.g., directly or through an intermediate device such as the mobile communications device 16) may be used by the trainable transceiver 10 to communicate with the home electronics device 12, remote device 18, and/or other device. In some embodiments, the home electronics device 12, remote device 18, and/or other device is configured to connect to the internet 200. For example, the device may include a radio frequency transceiver allowing for communication with an internet connected WiFi router. The communication between the trainable transceiver 10 and the device using the internet 200 and/or intermediate devices may be unidirectional or bidirectional. For example, the trainable transceiver 10 may transmit activation signals, control signals, data, and/or other information to the device. The activation signal may activate and/or otherwise control the device. Continuing the example, the device (e.g., the home electronics device 12, remote device 18, and/or other device), may transmit information to the trainable transceiver 10 using the internet 200 and/or intermediate devices. The information may include status information, diagnostic information, activation signal receipt confirmation, and/or other information.

Referring now to FIG. 8B, in one embodiment, the transmission from the trainable transceiver 10 using the internet 200 and/or the internet 200 and an intermediate device (e.g., the mobile communications device 16) may be received by a second trainable transceiver 202. The second trainable transceiver 202 may be connected to the internet 200 directly or through an intermediate source. For example, the second trainable transceiver 202 may include a cellular transceiver configured to connect the trainable transceiver 202 to the internet 200. Alternatively, the trainable transceiver 202 may include a wireless transceiver and/or wired connection configured to connect the second trainable transceiver 202 to a router, modem, and/or other networking hardware configured to connect the trainable transceiver 202 to the internet 200.

The second trainable transceiver 202 may be placed such that one or more home electronic device 12, remote devices 18, and/or other devices are within the transmission range of the transceiver circuit of the trainable transceiver 202 and/or an additional transceiver of the trainable transceiver 202. Upon receiving a transmission from the first trainable transceiver 10 via the internet 200 and/or intermediate devices, the second transceiver 202 may relay the communication to one or more devices. For example, the first trainable transceiver 10 may transmit an activation signal, activation signal parameters and an activation signal transmission request, data, instructions and/or other information to the second trainable transceiver 202 using the internet 200 and/or other hardware. The second trainable transceiver 202 may interpret the information received from the first trainable transceiver 10 and take further action. For example, the second trainable transceiver 202 may format an activation signal and transmit the activation signal to one or more devices based on the information received from the first trainable transceiver 10. This may include executing instructions received from the first trainable transceiver 10 (e.g., using a control circuit and/or memory of the second trainable transceiver 202), retransmitting an activation signal received from the first trainable transceiver 10, retransmitting information received from the first trainable transceiver 10, and/or otherwise manipulating, processing, and/or transmitting information based on the information received from the first trainable transceiver 10. In one embodiment, the second trainable transceiver 202 may be placed in a garage and/or coupled to an internet connected device located in a garage. This may enable the second trainable transceiver 202 to control devices such as a garage door opener based on information received from the first trainable transceiver 10 while the first trainable transceiver 10 is outside of its transmission range with the garage door opener. Advantageously, this system may allow the first trainable transceiver 10 to receive a user input and for the user input to result in controlling the garage door opener even through the garage door opener is outside of the transmission range 192 of the transceiver circuit of the first trainable transceiver 10.

In some embodiments, the home electronics device 12, remote device 18, and/or other device may be configured to connect to the internet 200. The device may include a WiFi transceiver for connecting to a router, network card, wired connection to a router or modem, cellular transceiver, and/or other hardware for accessing the internet 200. For example, a garage door opener may include a WiFi transceiver for connecting to a router and/or home network with access to the internet 200. The garage door opener may be configured to send status information to the mobile communications device 16 and/or trainable transceiver 10 via the internet 200. The status information may be displayed to a user and/or vehicle occupant. For example, the mobile communications device 16 may display the information on a display included in the mobile communications device 16. The mobile communications device 16 may transmit the information to the trainable transceiver 10 using one or more of the communication techniques described herein (e.g., light based, sound based, using a BLE transceiver, etc.). The trainable transceiver 10 may display status information to a vehicle occupant using a display included in the trainable transceiver 10, a vehicle display controllable by the trainable transceiver 10 (e.g., in the rear view mirror 70 or infotainment center), and/or other displays. In some embodiments, status information may be communicated to a user and/or vehicle occupant using a speaker associated with the mobile communications device 16, trainable transceiver 10, rear view mirror 70, and/or vehicle electronics system. Status information may include whether the garage door is open or closed, the last command received, a history of activation signals received including time of reception, source, and/or other information, etc. Status information may be sent by any home electronics device, remote device, and/or other device with access to the internet 200 and/or using another communication technique described herein. Status information may include information related to devices other than garage door openers. For example, status information may include whether a home lighting system is on or whether the lights are off.

Figure 9:
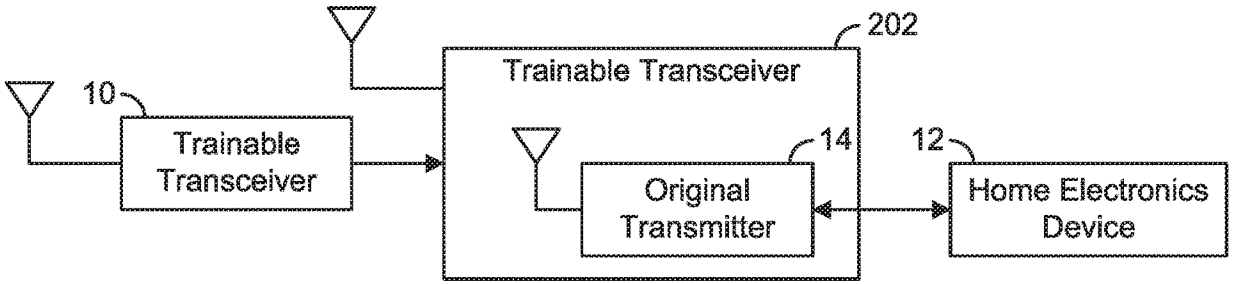
FIG. 9 illustrates an exemplary embodiment of a trainable transceiver configured to control a device using a second trainable transceiver mechanically coupled to an original transmitted associated with the device.

Referring now to FIG. 9, the trainable transceiver 10 may be configured to operate with a second trainable transceiver 204 in physical contact with the original transmitter 14 in some embodiments. The first trainable transceiver 10 may send an activation signal and/or other information to the second trainable transceiver 204 which is in physical contact with the original transmitter 14 of the home electronics device 12, remote device 18, and/or other device. In response to the signal received from the first trainable transceiver 10, the second trainable transceiver 204 may physically activate the original transmitter 14. The original transmitter 14 may send an activation signal to the corresponding home electronics device 12, remote device 18, and/or other device in response to being physically activated. For example, the second transceiver 204 may include an electric motor, solenoid, and/or other electromechanical system configured to depress a button or other input mechanism included in the original transmitter 14. In response to receiving the physical input of the second trainable transceiver 204, the original transmitter 14 may send an activation signal.

Advantageously, this configuration may allow a first trainable transceiver 10 to control the home electronics device 12, remote device 18, and/or other device without being trained to format an activation signal for controlling the device. For example, the first trainable transceiver 10 and the second trainable transceiver 204 may communicate using a fixed frequency or frequencies (e.g., the 900 MHz band). The first trainable transceiver 10 and the second trainable transceiver 204 may use an encryption technique to communicate securely. For example, the first trainable transceiver 10 and the second trainable transceiver 204 may communicate using a rolling code that is known to both trainable transceivers without requiring the trainable transceivers to be trained. For example, the rolling code may be provided to a pair of trainable transceiver sold together prior to sale.

Generally, the trainable transceiver 10 and/or the mobile communications device 16 may have further auxiliary functions which make use of one or more of the communications techniques and/or other operational techniques previously described herein.

In one embodiment, the mobile communications device 16 may be used to notify a user when the trainable transceiver 10 receives status information from the home electronics device 12, remote device 18, and/or other device in communication with the trainable transceiver 10. Upon receiving status information from the device, the trainable transceiver 10 may communicate this information and/or an instruction or other information to the mobile communications device 16. The trainable transceiver 10 may communicate with the mobile communications device 16 using one or more of the techniques described with reference to FIGS. 2A-3B (e.g., using a Bluetooth protocol).

In response to the information and/or instructions received from the trainable transceiver 10, the mobile communications device 16 may notify a user based on the information. In some embodiments, the mobile communications device 16 notifies the user using one or more of a display, a speaker, and/or a vibration motor. For example, a user may provide an input to the trainable transceiver 10 causing an activation signal to be sent to close a garage door. The garage door opener may receive the activation signal and close the garage door. The garage door opener may send status information indicating the garage door is closed to the trainable transceiver 10 using one or more of the bi-directional (e.g., two-way) communications techniques described herein (e.g., the garage door opener sends information using a transceiver circuit which the trainable transceiver 10 receives using the transceiver circuit 26). The trainable transceiver 10 may then transmit this information and/or an instruction (e.g., to turn on the vibration motor of the mobile communications device 16 for a set period of time) to the mobile communications device 16 (e.g., using the BLE transceiver 32). The mobile communications device 16 may receive the information and/or instruction (e.g., using the BLE transceiver 64). The mobile communications device 16 may then process, execute, and/or otherwise manipulate the instructions and/or information received in order to produce a notification. For example, the mobile communications device 16 may execute an instruction to turn on the vibration motor causing the phone to shake or vibrate. This may notify the user that the garage door has been closed. In some embodiments, a user may configure and/or customize the notifications produced in response to particular information received from the trainable transceiver 10. In some embodiments, the user makes this customization through an application running on the mobile communications device 16.

In some embodiments, the mobile communication device 16 in communication with the trainable transceiver 10 may provide the trainable transceiver 10 information about the current position of the trainable transceiver 10. The mobile communications device 16 may receive position information from a GPS sensor and/or other device included in the mobile communications device 16. The mobile communications device 16 may communicate this information to the trainable transceiver 10 using one or more of the communication techniques described in reference to FIGS. 2A-3B. In other embodiments, position information may be provided to the trainable transceiver 10 from another source such as sensors included in the trainable transceiver 10, a vehicle electronics system, and/or other hardware.

Using position information, the trainable transceiver 10 may have multiple functions associated with one operator input device of the trainable transceiver (e.g., a single button). For example, a single button may cause an activation signal to be transmitted or cause a mobile communications device function to be performed depending on the location (e.g., position) of the trainable transceiver 10 as described with reference to FIGS. 4D-5. Using the trainable transceiver 10 and/or a mobile communications device 16, a user may configure the trainable transceiver 10 to perform particular functions based on the location of the trainable transceiver 10. For example, the trainable transceiver 10 may have access to position information corresponding to the locations of device for which the trainable transceiver 10 is trained to control. For example, the trainable transceiver 10 may store position information in memory 24 during the training process as previously described. In other embodiments, position information related to the devices may be provided by a user through the mobile communications device 16. For example, a user may provide an address and/or map location corresponding to a device which the mobile communications device 16 uses to determine position information (e.g., GPS coordinates). The mobile communications device 16 may then transmit this information to the trainable transceiver 10.

The trainable transceiver 10 may determine what function to perform based on one or more of the current position of the trainable transceiver 16, the position of the devices which the trainable transceiver 10 is configured to control, and/or configuration, settings, parameters, and/or other information provided by a user. For example, a user may set location boundaries in which an input to the trainable transceiver 10 performs a particular action. For example, the user may set the boundary as 20 miles from the device. Within 20 miles of the device, pressing a button on the trainable transceiver 10 may send an activation signal to the device. If the trainable transceiver 10 is within 20 miles of a second device, pressing the same button on the trainable transceiver 10 may send an activation signal to the second device. Thus, the user may set geographic areas in which the trainable transceiver 10 performs certain functions. The geographic areas may be based on the location of one or more devices (e.g., home electronics devices, remote devices, and/or other device) with the location of the trainable transceiver 10 determined from position information provided by the trainable transceiver 10 itself, the mobile communications device 16, a vehicle electronics system, and/or another source. In other embodiments, the function performed by an input to the trainable transceiver 10 may be determined by the transmission range 192 of the trainable transceiver 10 as discussed with reference to FIGS. 4D-5. Similar techniques may be used to control one or more functions of the mobile communications device 16 and/or an application running thereon. For example, an application for sending control signals to device (e.g., through the trainable transceiver 10, through the internet 200, and/or through additional hardware) may be reconfigured based on the location of the trainable transceiver 10 and/or mobile communications device 16. The buttons corresponding to device which are controllable may change based on which geographic boundary the mobile communications device 16 is in and/or based on the transmission range 192 of the trainable transceiver 10 (e.g., which devices are within the transmission range 192).

In other embodiments, additional techniques may be used in place of or in conjunction with those described above. For example, the trainable transceiver 10 may be configured to perform multiple functions based on a single input (e.g., one button can send two different activation signals). The function which is performed by the input may be determined based on which corresponding device is closest to the trainable transceiver 10. For example, the button may be configured to send an activation signal to one of two devices for which the trainable transceiver 10 has access to position information. Using the position of the two devices and the current position of the trainable transceiver 10, the trainable transceiver 10 may send an activation signal to the closer of the two devices upon receiving the user input. Particular activation signals (e.g., using codes for a particular device) may be tied to GPS locations.

Advantageously, the above described techniques may be used to allow the trainable transceiver 10 to control a plurality of devices at a plurality of locations while maintain a simple and easy to user interface. For example, three buttons may be used to control three devices at one location while also controlling three devices at a second, third, or other location. Advantageously, the trainable transceiver 10 may user location and/or position data as described above to automatically predict which device the user wishes to control with the user input. By anticipating the user's intentions based on the location of the trainable transceiver 10, the trainable transceiver 10 may provide a simple and easy to use interface for controlling many devices.

In some embodiments, one or more light sensors 86 and/or cameras 76 and 78 included in the rear view mirror 70 or elsewhere in or on the vehicle are used to receive communications from sources outside the vehicle. As described in reference to FIGS. 2A-3B, free-space optical communication techniques may be used by the rear view mirror 70 and/or trainable transceiver 10 to receive and interpret communications from sources located outside the vehicle. The received light may be interpreted using a control circuit and/or memory. The control circuit may be located in the trainable transceiver, rear view mirror, and/or vehicle electronics system. In some embodiments, free-space optical communication is used without the trainable transceiver 10 by the vehicle to receive communications.

Communications received from sources outside the vehicle may be used for a variety of functions. For example, a light source associated with a roadway toll system may communicate toll information to the vehicle using the light source. The vehicle may process the information and display information to a vehicle occupant. For example, the vehicle, rear view mirror 70, and/or trainable transceiver 10 may display the cost of the toll to a vehicle occupant. This information and/or other information may be displayed on a display associated with the trainable transceiver 10, rear view mirror 70 (e.g., integrated in the mirror), and/or the vehicle (e.g., an infotainment system). In some embodiments, a vehicle occupant may communicate information in response to the information received. For example, the user may provide an input to pay the toll. Using a transceiver associated with the trainable transceiver 10, rear view mirror 70, the connected mobile communications device 16, and/or the vehicle, payment information may be transmitted. In some embodiments, the payment information may be transmitted to a source and/or using signal parameters defined by the transmission received. For example, the light transmission may include a code, frequency, and/or other information which enables the trainable transceiver 10 to format a signal to send using the transceiver circuit 26 which may be received by a transceiver of the toll system. In other embodiments, other transceivers associated with the vehicle may be used. In further embodiments, one or more of the communication techniques described with reference to FIGS. 2A-3B may be used (e.g., light based, sound based, and/or using a transceiver).

In some embodiments, the same or similar techniques may be used for other applications. For example, points of interest may include a transceiver or light source which provides information to the vehicle about the point of interest as the vehicle approaches. This information may be displayed to a vehicle occupant. The information may include a summary of the point of interest, directions on how to get to the point of interest, and/or other information. Other applications may include receiving information about road side services such as the location of gas stations, fuel prices, etc. Traffic alerts and/or other public announcement information may be conveyed to a vehicle occupant using the same or similar techniques. In some embodiments, billboards and/or other advertisements may include a transceiver, light source, etc. for communicating information to the vehicle. This information may be displayed to a vehicle occupant. Other applications of the communications techniques described herein are possible.

In some embodiments, the home electronics device 12, remote device 18, and/or other device may be and/or include a wireless access point. For example, the wireless access point may be a mini access point. The wireless access point may operate on a WiFi protocol (e.g., an IEEE 802.11 protocol), create a network, and/or otherwise allow for communication between the device and other devices such as the trainable transceiver 10. In some embodiments, the device and/or wireless access point is not connected to the internet. In other embodiments, the device and/or wireless access point is connected to the internet. In further embodiments, the wireless access point may be implemented with another device such as a router to which other devices (e.g., home electronics devices 12, remote devices 18, trainable transceivers 10, mobile communications devices 16 and/or other devices) connect to a network.

The wireless access point and/or the network created by the wireless access point may be encrypted, password protected, and/or otherwise secured (e.g., using an IEEE 802.11 security algorithm such as Wired Equivalent Privacy (WEP), WiFi Protected Access II (WPA2), etc.). In some embodiments, the mobile communications device 16 may connect to the network using a password. The trainable transceiver 10 may also connect to the wireless network. In some embodiments, the password for the wireless network may be printed on the wireless access point and/or the device including the hardware creating the wireless access point. For example, the wireless access point may be created by a garage door opener with the password (e.g., WPA2 password) printed on the garage door opener. In some embodiments, the wireless access point may include software, firmware, computer programs, executable instructions, and are other information (e.g., stored in memory) which allows a connected device to access information about the wireless access point, a device creating the wireless access point, and/or devices connected to the wireless access point using a web browser interface. In some embodiments, the wireless access point stores in memory, local to the wireless access point, activation signal parameters signal parameters, training information, and/or other information related to the device including the wireless access point. In other embodiments, activation signal parameters signal parameters, training information, and/or other information related to the home electronics device 12 and/or remote device 18 is stored locally to the device and is accessible via a connection between that device and a wireless access point.

For example, a garage door opener may establish a wireless network and function as a wireless access point. A mobile communications device 16 may connect to the wireless network/wireless access point (e.g., using a WiFi transceiver). Using a web browser and/or other application on the mobile communications device 16, a user may access instructions for training the trainable transceiver 10 to control the garage door opener. The mobile communications device 16 may also access activation signal parameters signal parameters, training information, and/or other information related to the garage door opener. The mobile communications device 16 may use the information to display training instructions to a user on the display of the mobile communications device 16 and/or otherwise train the trainable transceiver 10. The information accessed by the mobile communications device 16 may be stored locally on a device including a wireless access point and/or connected to a wireless access point.

In some embodiments, the mobile communications device 16 may use information accessed via the wireless access point to train the trainable transceiver 10 which is in communication with the mobile communications device 16. For example, the mobile communications device 16 may use the information form the wireless access point to create instructions and/or information which cause the trainable transceiver 10 to be trained to control the device using one or more the of techniques described herein (e.g., the trainable transceiver 10 executes instructions received from the mobile communications device 16). The mobile communications device 16 may communicate information and/or instructions to the trainable transceiver 10. In other embodiments, a user may enter information visible through the web browser into the trainable transceiver 10 and/or an application of the mobile communications device 16 manually. The manually entered information may be communicated to the trainable transceiver 10 using the mobile communications device 16 and/or otherwise used by the trainable transceiver 10 in order to configure the trainable transceiver 10 to control the device associated with the information. In further embodiments, the trainable transceiver 10 may connect to the wireless access point directly (e.g., using a WiFi transceiver). The trainable transceiver 10 may acquire activation signal parameters signal parameters, training information, and/or other information related to a device running the wireless access point and/or connected to the wireless access point. The trainable transceiver 10 may use this information to configure itself to control one or more devices.

In some embodiments, the device creating the wireless access point and/or devices connected to the wireless access point may be controlled using a web browser and an additional device connected to the wireless access point such as the trainable transceiver 10 and/or mobile communications device 16 which runs the web browser. The device running the web browser may connect automatically to the network created by the wireless access point when the device running the web browser comes into communications range of the wireless access point (e.g., the device detects the network created by the wireless access point). For example, as a vehicle drives towards a garage door opener including and/or functioning as a wireless access point, a mobile communications device 16 that has previously connected to the wireless access point may automatically connect to the wireless access point.

Once connected to the wireless access point (e.g., through the network created by the wireless access point), the device including the web browser (e.g., the trainable transceiver 10, vehicle electronics system such as infotainment system, mobile communications device 16, and or other device) may control the home electronics device 12, remote device 18, and/or other device connected to the wireless access point using a web browser. For example, the web browser may be used to change a parameter of a device connected to the wireless access point, send an instruction to the device, and/or otherwise communicate with the device. Upon receiving the communication, the device may interpret the communication in such a way as to allow the device to be controlled by the web browser and associated communication. For example, a garage door opener may function as or include a wireless access point. Upon connecting to the garage door opener, a device running a web browser may be presented with a graphical user interface based on information communicated from the garage door opener. The web browser may then be used in conjunction with the graphical user interface to communicate instructions to the garage door opener. For example, a user may use the web browser to press a button corresponding to closing the garage door. Pressing the button may send corresponding information to the garage door opener that the user has pushed the button. The garage door opener may use this information to activate the garage door opener and close the garage door.

Using the web browser interface, the device creating and/or including the wireless access point may transmit information to the device running the web browser and cause it to display the information via the web browser. For example, the wireless access point may send information such as status information related to the home electronics device 12, remote device 18, and/or other device that causes the web browser to refresh and display the information. Continuing the example, the wireless access point may be a garage door opener which transmits (e.g., serves) information to the mobile communications device 16 connected to the wireless access point. This information may be that the garage door is down. The web browser may refresh and display this information to a user on the display of the mobile communications device 16 as part of a graphical user interface (e.g., text, icons, images, etc.).

The above described examples describe the web browser as running on the mobile communications device 16. In some embodiments, the web browser runs on the trainable transceiver 10 including a WiFi transceiver which allows the trainable transceiver 10 to connect to the access point. The web browser may be displayed on a display included in the trainable transceiver 10 and/or otherwise accessible to the trainable transceiver 10 (e.g., a display in a rear view mirror). In other embodiments, the web browser may be running on a vehicle electronic system such as an infotainment system where the vehicle includes a WiFi transceiver allowing the vehicle to connect to the wireless access point. Using the above described techniques, a wireless access point may be used to communicate activation signal parameters signal parameters, training information, and/or other information related to the home electronics device 12 and/or remote device 18 to the trainable transceiver 10 for use in training the trainable transceiver 10. Additionally, the wireless access point may be used to control one or more home electronics device 12 and/or remote devices 18 using a web browser.

In further embodiments, one or more of the above described techniques may be used to place the home electronics device 12, remote device 18, and/or other device into a training mode. For example, a web browser on the mobile communications device 16 may be used to send information to the wireless access point and/or the home electronics device 12 or remote device 18 to place the device into a training mode. Upon receiving the information, the device may enter a training mode. When in the training mode, the device (e.g., garage door opener) may be configured to receive an activation signal from a transceiver. The activation signal received during the training mode may be used to configure the device (e.g., garage door opener) to be controlled by an activation signal having the activation signal parameters of the activation signal received during the training mode. For example, the activation signal parameters of the activation signal received during the training mode may be saved in memory local to the device (e.g., garage door opener). Following the training mode, the garage door opener may be configured to only be controlled by an activation signal having the activation signal parameters stored in memory. In some embodiments, the web browser may be used to exit the training mode. In other embodiments, the training mode may end after a predetermined amount of time (e.g., 30 seconds) and/or when an activation signal is received. Other techniques may be used to control the training mode of the device.

In some embodiments, the home electronics device 12, remote device 18, and or other device may be controlled and/or communicated with using a communication technique based on the internet and/or a telephone network (e.g., wired or wireless such as a cellular network). For example, a device may have an internet standard messaging address, be configured to receive communications using an internet message format standard, be configured to receive a message using a simple mail transfer protocol, receive a message using an internet instant messaging protocol, receive an e-mail, have a host name, and/or otherwise receive a communication using the internet and/or another network. To carry out one or more of these functions, the device may include networking hardware such as a networking card, be connected to internet (e.g., via a wired connection to a router or modem or a wireless connection to a router or modem suing a transceiver such as a WiFi transceiver), and/or otherwise include hardware and/or software for communicating using one or more of the above communications techniques. Alternatively or additionally, the device may be configured to receive SMS messages, fax messages, voice over internet protocol (VoIP) communications, and/or otherwise receive communications over a wired or wireless (e.g., cellular) telephone and/or data network. To carry out one or more of these functions, the device may include a cellular transceiver, wired connection to a telephone line, access to the internet (e.g., through a WiFi transceiver), and/or other hardware and/or software to carry out the above described communications techniques. In some embodiments, the above described communications techniques may allow the device to send communications as well as to receive communications.

Using one or more of the above described communications techniques, the mobile communications device 16 may be able to control the home electronics device 12, remote device 18, and/or other device. Controlling the home electronics device 12, remote device 18, and/or other device may include such actions as placing the device into a training mode, causing the device to activate, causing the device to change status, causing the device to send a communication (e.g., send status information), and/or otherwise causing the device to take an action. In some embodiments, the device may be controlled (e.g., activated) based on receiving a communication using one of the above described techniques. For example, a garage door opener may be configured to activate a motor to open or close the garage door upon receiving an SMS message. The mobile communications device 16 may send the SMS message through a messaging feature and/or through an application. In some embodiments, the address (e.g., telephone number) of the garage door opener is received by the mobile communications device 16 during a training process. In other embodiments, the address may be manually entered by a user (e.g., the address may be provided in a user manual, printed on the device, etc.). In other embodiments, the content of the SMS message received controls the device. For example, the content of the SMS message may include a rolling code or other encryption component and/or a command component such as instruction to raise the garage door. Similar techniques (e.g., controlling the device based on the presence of the communication or content of the communication) may be used with other of the described communication techniques (e.g., e-mail wherein the device has an e-mail address). The information related to controlling a device using one or more of these techniques may be provided to the mobile communications device 16 using one or more of the training processes or techniques previously described and/or other training techniques.

In other embodiments, a device other than the mobile communications device 16 may communicate with the home electronics device 12 or remote device 18 using one or more of the above described techniques. For example, the trainable transceiver 10 may include a cellular transceiver or other hardware which allows the trainable transceiver 10 to communicate over the internet and/or over a telephone and/or data network. Continuing the example, the trainable transceiver 10 may send a SMS message to device in response to a user input via a cellular transceiver. The SMS message may control the device which receives the message. Part of the training of the trainable transceiver 10 may include acquiring address information, telephone information, and/or other information which allows the trainable transceiver 10 to communicate with the device using one or more of the above described techniques.

In some embodiments, one or more of the bidirectional communication techniques for communication between (1) the home electronics device 12, remote device 18, and/or other device and (2) the trainable transceiver 10 are used to provide the status of a device associated with one or more locking mechanisms to a vehicle occupant. The device associated with the locking mechanism may be the home electronics device 12. For example, the device may be a smart lock configured to allow a door to be locked on unlocked wirelessly. For example, the smart lock may be configured to communicate with another device (e.g., the mobile communications device 16) via a Bluetooth protocol, using the internet, and/or using another wireless communications system (e.g., by SMS message, e-mail, etc.). In some embodiments, the smart lock is a wireless access point, includes a wireless access point, and/or is otherwise controllable using a web browser. The smart lock may be configured to connect to the internet.

Using a smart lock connected to the internet, the trainable transceiver 10 may receive status information from the smart lock. For example, the trainable transceiver 10 may use a cellular transceiver to access the internet and request status information from the smart lock. In other embodiments, the smart lock sends status updates to the trainable transceiver 10. Status updates may be sent continuously, periodically, when the status changes, and/or at other times. One or more of the communication techniques described herein may be used to allow the smart lock and the trainable transceiver 10 to communicate (e.g., the use of intermediate devices). Status information (e.g., status updates) may be or include whether the door or doors are locked or unlocked, when the door or doors where last locked on unlocked, by whom the doors were locked or unlocked, an image of the person locking or unlocking the door or doors, a history of status changes including one or more of the previous, and/or other information related to the smart lock.

The trainable transceiver 10 may display the status information to a user and/or vehicle occupant. For example, the trainable transceiver 10 may display the status information using a display incorporated in a rear view mirror, display included in the trainable transceiver 10, vehicle display such as an infotainment system, and/or another display coupled to or controllable by the trainable transceiver 10. In some embodiments, the status information may be displayed to a user via the mobile communications device 16. For example, the trainable transceiver 10 may communicate status information to the mobile communications device 16 using one or more of the communication techniques described herein (e.g., using a Bluetooth protocol). The mobile communications device 16 may display the status information using a display. In embodiments where the mobile communications device 16 is used as an intermediate device to facilitate communication between the trainable transceiver 10 and device, the mobile communications device 16 may display status information received from the home electronics device 12, remote device 18, or other device. In further embodiments, status information may be used to generate an audible notification (e.g., using a speaker included in or controllable by the trainable transceiver 10 and/or a speaker included in the mobile communications device 16).

In some embodiments, the trainable transceiver 10 is configured to provide a temporary code which allows for communication (e.g., sending activation signals) to the home electronics device 12, remote device 18, and/or other device. For example, the trainable transceiver 12 may generate a temporary code which may be used by another trainable transceiver to operate a garage door opener. In some embodiments, the temporary code is communicated to the home electronics device 12 and/or remote device 18 by the original trainable transceiver 10 (e.g., as an activation signal or other communication). Upon receiving the temporary code and/or an instruction, the device may configure itself to accept an activation signal using the original activation signal parameters and/or activation signal parameters including the new code. The code may be any activation signal parameter. For example, the temporary code may be a rolling code. The device which receive the temporary code may store both the temporary code and an original code. In some embodiments, the original trainable transceiver 10 includes instructions with the temporary code transmitted to the device which cause the device to erase the temporary code from memory after a certain amount of time (e.g., 24 hours). In other embodiments, the original trainable transceiver 10 may be used by a user to erase the temporary code from the device after it is no longer needed. For example, the user may provide an input to the original trainable transceiver 10 which causes the trainable transceiver 10 to transmit an instruction to the device to erase the temporary code. In other embodiments, the temporary code may be generated using the mobile communications device 16 and communicated to the device using one or more of the techniques described herein (e.g., directly to the device, to the device through internet, to the device using the trainable transceiver 10 paired to the mobile communications device 16, etc.). The code may be generated using an application running on the mobile communications device 16.

The temporary code may also be provided to a second trainable transceiver for use by a person other than the user who generated the temporary code. For example, a temporary code may be generated by the trainable transceiver 10 or mobile communications device 16 using one of the techniques described herein (e.g., generating an encryption code and transmitting it to the device to be controlled, reading an encryption code value or values from memory which correspond to codes stored by the device to be controlled and providing the value or values to as a temporary code). The generated code may then be communicated to the mobile communications device 16. In one embodiment, the temporary code is generated by the trainable transceiver 10 and transmitted to a first mobile communications device. The first mobile communications device may communicate the temporary code to a second mobile communications device (e.g., using Bluetooth and/or an application). Alternatively, the trainable transceiver 10 may generate the temporary code and transmit it directly (e.g., using a Bluetooth transceiver) to a second mobile communications device (e.g., a mobile communications device owned by the person to receive the temporary code). In other embodiments, the temporary code may be generated by a first mobile communications device in communication with the trainable transceiver 10. For example, the first mobile communications device may be storing activation signal parameters received from the trainable transceiver which may be used to generate a temporary code. Alternatively, the first mobile communications device may generate a temporary code an d transmit it to a device (e.g., garage door opener) via the trainable transceiver 10 such that the device stores the temporary code as explained above. The first mobile communications device may communicate the temporary code to a second mobile communications device (e.g., using Bluetooth, NFC, the internet, etc.). In some embodiments, the temporary code includes activation signal parameters, training information, and/or other information related to a device associated with the temporary code. Alternatively, this information may be transmitted along with the temporary code. The temporary code and/or activation signal parameters, training information, and/or other information related to a device associated with the temporary code may be used to control an associated device. In further embodiments, a first mobile communications device may transmit the temporary code and/or other information to the second mobile communications device using the internet, servers, a cloud architecture, and/or other hardware and software for allowing wireless communication between two mobile communications devices.

Upon receiving the temporary code, the second mobile communications device may be used to directly or indirectly control the home electronics device 12, remote device 18, and/or other device associated with the temporary code. In one embodiment, the second mobile communications device uses the temporary code to control the home electronics device 12, remote device 18, and/or other device associated with the temporary code directly. The second mobile communications device may communicate with a device using one or more of the techniques described herein. For example, the second mobile communications device may communicate with the device using a Bluetooth protocol. The second mobile communications device may pair with the device and provide the device with a control instruction (e.g., activation signal) and the temporary code. Without the temporary code or other code, the device may not receive or execute the activation signal or control instruction transmitted by the second mobile communications device. In some embodiments, the second mobile communications device may receive pairing instructions along with the temporary code. If the device (e.g., garage door opener) determines that the temporary code matches a corresponding temporary code or the code stored by the device, the device may be activated or otherwise controlled by the transmission from the second mobile communications device. For example, the trainable transceiver 10 may generate a temporary code which is transmitted to the garage door opener and to the second mobile communications device (e.g., by a first mobile communications device which receives the temporary code from the trainable transceiver 10). Along with the temporary code, the second mobile communications device may receive pairing information corresponding to the garage door opener. When the second mobile communications device is brought within transmission range, the second mobile communications device may pair with the garage door opener. The mobile communications device may then transmit an activation signal including the temporary code. The garage door opener may check the received temporary code (e.g., the temporary code from the second mobile communications device) with the temporary code stored in memory (e.g., the temporary code received from the trainable transceiver 10). If the two codes match, the garage door opener may execute the instruction received from the second mobile communications device along with the temporary code (e.g., open the garage door).

In other embodiments, the second mobile communications device may pair with a second trainable transceiver located within transmission range of the device to which the temporary code corresponds. For example, a second trainable transceiver may be located within a garage and within transmission range of one or more home electronics devices (e.g., a garage door opener), remote devices, and/or other devices. The second mobile communications device may communicate with the second trainable transceiver and provide an instruction and/or information (e.g., activation signal parameters, device identification information, etc.) to the second trainable transceiver in conjunction with the temporary code. In response to the communication from the second mobile communications device, the second trainable transceiver may send an activation signal including the temporary code to the device associated with the temporary code (e.g., using the transceiver circuit of the second trainable transceiver). The device may be controlled based on this transmission.

In other embodiments, the second mobile communications device may pair with a second trainable transceiver located within a second vehicle. The second mobile communications device may provide the second trainable transceiver with the temporary code and/or other information for controlling the associated device (e.g., activation signal parameters, training information, etc.). Using this information, the second trainable transceiver may control the device. For example, a user may generate a temporary code as explained above and transmit the temporary code to a mobile communications device in the possession of another person (e.g., a friend). The other person may provide the information to their trainable transceiver (e.g., a different trainable transceiver which is located in their vehicle). The other person may then drive to the location of the user's home and activate the device (e.g., the user's garage door opener) with their trainable transceiver and the activation signal parameters, temporary code, and/or other information provided by the other person's mobile communications device to their trainable transceiver. This may allow a user to provide another person with temporary control of their device through the other person's own trainable transceiver.

In other embodiments, the temporary code may be a one-time use code. For example, the code may be a single encryption code (e.g., a fixed code, one code of a roll of rolling codes, etc.). In further embodiments, the temporary code may be a series or plurality of codes (e.g., 250 of the next codes in the rolling code sequence). For example, the trainable transceiver 10 and/or mobile communication devices 16 may transmit one rolling code value to the second trainable transceiver (e.g., through an intermediate mobile communications device or devices). When the a second trainable transceiver sends an activation signal using the rolling code value which is received by a device, the device may activate as the code value matches a value expected by the device. Upon receiving the code value, the device may advance the roll. The second trainable transceiver will not be able to control the device again as the second trainable transceiver does not have the new code value. In some embodiments, the a second trainable transceiver may be given a fixed number of codes. For example, the additional trainable transceiver may be given two codes, one to open a garage door and one to close a garage door. This may allow the second trainable transceiver to send an activation signal with a first code which the device receives and then the device advances the roll to a new code. The second trainable transceiver may have another code which corresponds to the next code in the roll such that the second code of the second trainable transceiver matches the new code of the device and the second trainable transceiver may send an activation code with the correct rolling code value to control the device.

Figure 10A:
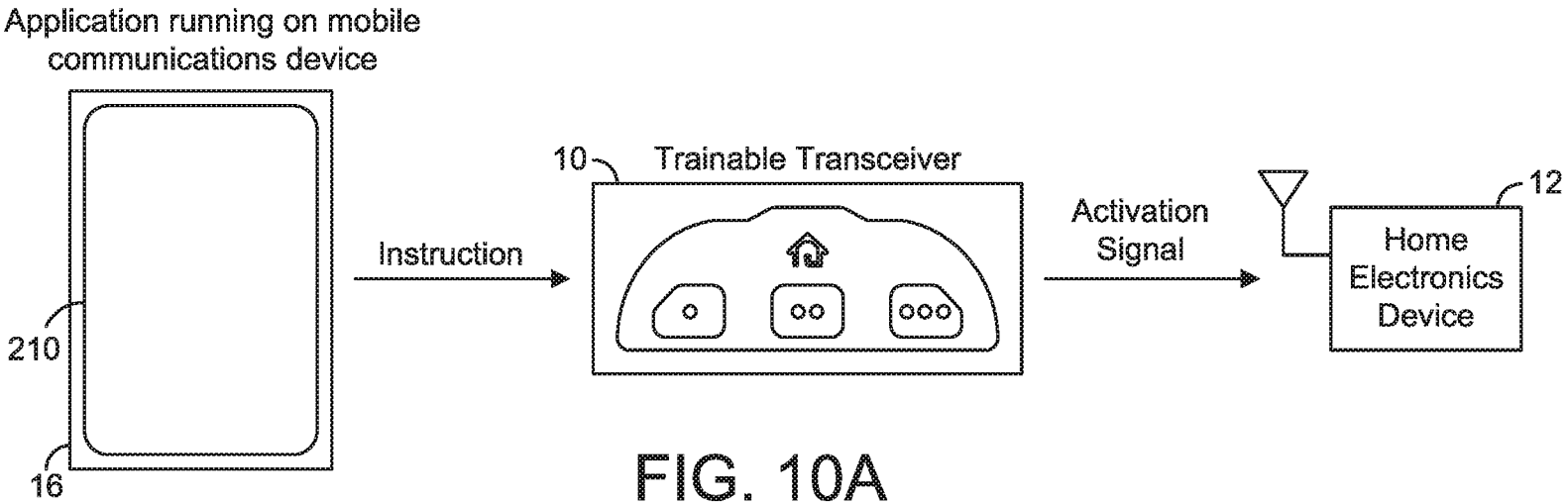
FIG. 10A illustrates an exemplary embodiment of a trainable transceiver configured to receive an instruction for a mobile communications device and to control another device in response to the instruction.
Figure 10B:
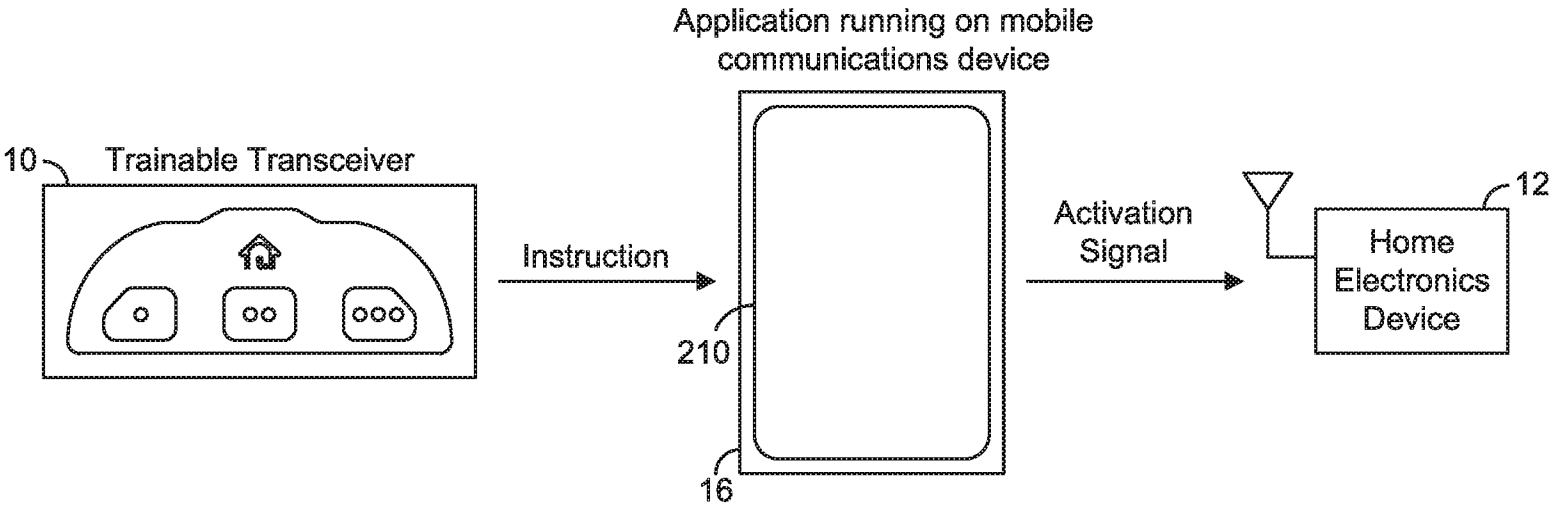
FIG. 10B illustrates an exemplary embodiment of a trainable transceiver configured to communicate an instruction to an mobile communications device which causes the mobile communications device to control another device.

Referring now to FIGS. 10A and 10B, the mobile communications device 16 running an application 210 may be used in conjunction with the trainable transceiver 10 to control and/or otherwise communicate with the home electronics device 12, remote device 18, and/or other device. The trainable transceiver 10 and mobile communications device 16 may communicate using more or more of the techniques described herein. For example, the trainable transceiver 10 and mobile communications device 16 may communicate using BLE transceivers and a Bluetooth protocol.

Referring now to FIG. 10A, the application 210 running on the mobile communications device 16 may be used to send an activation signal to and/or otherwise communicate with the home electronics device 12, remote device 18, and/or other device. A user may provide an input to the application using a graphical user interface (e.g., buttons, fields, menus etc.). The input may correspond to controlling a device. For example, a user may push a button to turn on lights at the user's home. In response to the input, the mobile communications device 16 may transmit instructions and/or information to the trainable transceiver 10. The trainable transceiver 10 may send an activation signal based on the instructions and/or information received causing the control function associated with the user input received by the application. Continuing the example, the trainable transceiver 10 may receive the instruction to turn on the lights and format and send an activation signal to the lighting device associated with the user input. The device may receive the activation signal and/or other information and be controlled according to the user input received by the application on the mobile communications device 16. In other embodiments, the application 210 and/or mobile communications device 16 may control and/or communicate with the home electronics device 12, remote device 18, and/or other device without the trainable transceiver 10. One or more of the communication techniques described herein may be used in conjunction or in place of those described above. For example, an application programming interface (API), messaging techniques (e.g., SMS message, e-mail, etc.), push notifications, IP communication, cellular communication, and/or other techniques, software, and hardware may be used by the mobile communications device 16, with or without the trainable transceiver 10, such that the application 210 may control a device.

Referring now to FIG. 10B, the trainable transceiver 10 may be used to control the application 210 running on the mobile communications device 16 which in turn controls the home electronics device 12, remote device 18, and/or other device based on the input received from the trainable transceiver 10. Advantageously, this may allow a vehicle occupant to control a device using the application 210 on the mobile communications device 16 without taking the mobile communications device 16 out of a pocket or otherwise looking at the mobile communications device 16. The controls of the trainable transceiver 10 may be more conveniently located (e.g., on a headliner or rear view mirror) for use while operating a vehicle. A user may provide an input to the trainable transceiver (e.g., by pushing a button corresponding to a particular device, speaking a voice command, etc.). The trainable transceiver may communicate an instruction and/or information based on the input received. For example, the trainable transceiver 10 may communicate an instruction for the application 210 to take a particular acting using a Bluetooth protocol.

The application 210 may receive the instruction and/or information via the mobile communications device 16. In some embodiments, an API may be used in order to coordinate communication between the trainable transceiver 10 and the application 210. In response to the communication from the trainable transceiver 10, the application 210 may take further action to control and/or otherwise communicate with a device. The application 210 may cause the mobile communications device 16 to send an activation signal and/or otherwise communicate with the device associated with the input received by the trainable transceiver 10. The application 210 may take this action based on the instructions and/or information received from the trainable transceiver 10. For example, the application 210 and/or mobile communication device 16 may send an activation signal to the home electronics device 12 using one or more of the communication techniques described herein (e.g., via the internet, using messaging such as SMS messaging or e-mail, using a cellular transceiver, etc.). The home electronics device 16 may receive the activation signal and be controlled according to the user input received by the trainable transceiver 10.

In some embodiments, the above described techniques with reference to FIG. 10B may be used to control applications on the mobile communications device 16 unrelated to controlling the home electronics device 12 or remote device 18. For example, the trainable transceiver 10 may receive a user input which the trainable transceiver 10 communicate to a particular application running on the mobile communications device 16 (e.g., a camera application). The application may receive the user input from the trainable transceiver 10 in the form of instructions and/or information transmitted by the trainable transceiver 10. An API may be used to facilitate communication between the mobile communication device 16 and the trainable transceiver 10. In response to the instruction and/or information received, the application may be controlled, take and action, and/or otherwise be manipulated according to the instructions and/or information.

One or more security features may be used in conjunction with the transfer of information from a first trainable transceiver to a second trainable transceiver. In one embodiment, a time limit is placed on the transfer of information such that the transfer must be initiated within the time limit or information will not be transferred. This technique may be used in embodiments where information may be transferred using the mobile communications device 16. For example, the application 210 on the mobile communications device 16 may be used to receive the information from the first trainable transceiver. The application 210 may automatically erase the information from memory included in the mobile communication device 16 upon the expiration of a set time period from when the information was received. For example, the time period may be ten minutes. The application 210 may communicate this time limit to a user (e.g., display a prompt on the display of the mobile communications device 16 such as "you have 10 minutes to transfer to the next vehicle"). If the transfer to the second trainable transceiver is initiated within the set time period, the information may be transferred to the second trainable transceiver. Once the transfer is complete, the mobile communications device 16 (e.g., using the application 210) may erase the information from memory.

Generally and with reference to the above disclosure related to transferring information, a biometric authentication may be required to transfer information from a first trainable transceiver to a second trainable transceiver using the mobile communications device 16 in some embodiments. For example, the application 210 on the mobile communications device 16 may require the user to have his or her fingerprint scanned by a fingerprint reader or other device included in the mobile communications device 16. The biometric authentication input may be required prior to the mobile communications device 16 receiving the information from the first trainable transceiver. Alternatively or additionally, the biometric authentication input may be required prior to the mobile communications device 16 transferring the information to the second trainable transceiver. Other biometric authentication inputs may be used in place of or in conjunction with fingerprints. For example, biometric inputs may include an image of the user's face (e.g., for facial recognition), palm print, DNA, image of the user's eye (e.g., for iris recognition), etc. In other embodiments, a password may be used instead. The biometric authentication input and/or password may be compared (e.g., using a control circuit and/or algorithm) to a corresponding reference stored in memory of the mobile communications device 16. The application 210 running on the mobile communications device 16 may require a user to input a biometric and/or password reference upon setup of the application 210, pairing with a trainable transceiver, and/or at other points in time or in response to other triggers. In other embodiments, the reference may be stored in and/or compared with one or more of a trainable transceiver, the cloud, and/or other hardware and software. Advantageously, one or more of the security features described herein may help to keep information related to home electronics devices, remote devices, and/or other devices secure. This may prevent unauthorized and/or unintended users from controlling a device using an activation signal.

In some embodiments, the trainable transceiver 10 may connect to the mobile communications device 16 (e.g., using Bluetooth) and/or connect to or otherwise interface with the application 210 associated with the home electronics device 12, remote device 18, and/or other device running on the mobile communications device 16. For example, an application programming interface (API), additional application, and/or other software or communication technique may be used to allow the trainable transceiver 10 to communicate with the application 210 associated with the home electronics device 12 (e.g., garage door opener) running on the mobile communications device 16 in communication with the trainable transceiver 10. This may allow the trainable transceiver 10 to control the application 210. For example, the trainable transceiver 10 may receive an input which causes the trainable transceiver 10 to communicate with the application 210 and trigger a function of the application 210. In embodiments where the application 210 is capable of controlling an associated device (e.g., sending commands using the internet to the device), the trainable transceiver 10 may use communication with application 210 to control the device using the application 210. For example, a user may provide an input on the trainable transceiver 10 which the trainable transceiver 10 uses in conjunction with an API and communication with the mobile communications device 16 to control the application 210 such that the application 210 is used to open or close a garage door opener. In further embodiments, the trainable transceiver 10 receives information from the home electronics device 12, remote device 18, and/or other device through the application 210 associated with the device on the mobile communications device 16. For example, the home electronics device 12 may provide information (e.g., status information) to the application 210 running on the mobile communications device 16. The trainable transceiver 10 may be in communication with the mobile communications device 16 and may receive this information from the application 210 (e.g., using an API). The trainable transceiver 10 may then convey the information to a user (e.g., by displaying the information using a display).

In further embodiments, the trainable transceiver 10 may be temporarily disabled. For example, a user may temporarily disable the trainable transceiver 10 when lending their vehicle including the trainable transceiver 10 to another person (e.g., lending the vehicle to a friend, having the vehicle parked by a valet, etc.). In one embodiment, the mobile communications device 16 and/or application 210 running thereon may transmit an instruction to the trainable transceiver 10 to enable or disable the trainable transceiver 10. Disabling the trainable transceiver 10 may be or include preventing the transmission of signals using a transceiver circuit, preventing access to one or more activation signal parameters, and/or otherwise preventing the trainable transceiver 10 from sending activation signals and/or communicating with a device. Enabling the trainable transceiver 10 may reverse the effects of disabling the trainable transceiver 10. In some embodiments, the enabling or disabling the trainable transceiver 10 may require a user to provide the trainable transceiver 10 with a security code. For example, the user may enter a security code on the mobile communications device 16 in communication with the trainable transceiver 10. In other embodiments, the user may enter the security code on the trainable transceiver 10.

In further embodiments, the mobile communications device 16 may transfer information to another mobile communications device using a combination of accelerometers and a wireless communication technique. For example, the mobile communications device 16 may acquire activation signal parameters, training information, and/or other information related to the home electronics device 12, remote device 18, and/or other device using one or more of the techniques described herein. The first mobile communications device which has acquired the information may transfer the information to a second mobile communications device. For example, the information may be transferred using NFC transceivers and an NFC protocol. In some embodiments, a user may be required to bump the two mobile communications devices such that an accelerometer in one or more of the mobile communications devices may register a bump and allow for transfer of the information. Advantageously, this input to the accelerometer may be used as a security feature which requires the two mobile communications devices to be bumped together prior to the transfer of the information. This may ensure that the transfer is intended based on the two devices being in close proximity and a near simultaneous acceleration experienced by both devices. Other communication techniques and/or security actions may be used in order to transfer information form a first mobile communications device to a second communications device. In further embodiments, the same or similar techniques may be used in order to transfer information from the trainable transceiver 10 and/or remote user interface module 140 of the trainable transceiver 10 to the mobile communications device 16.

In further embodiments, the mobile communications device 16 may be used to send an instruction to the trainable transceiver 10 to send an activation signal to a particular device. For example, a user may select a device to control using the application 210 on the mobile communications device 16. The mobile communications device 16 may send an instruction based on this input to the trainable transceiver 10 (e.g., using Bluetooth communication between the mobile communications device 16 and the trainable transceiver 10). The trainable transceiver 10 may send an activation signal in response to the instruction. In some embodiments, the mobile communications device 16 may transmit additional information to the trainable transceiver 10 such as activation signal parameters, training information, and/or other information related to the home electronics device 12, remote device 18, and/or other device. The trainable transceiver 10 may act as a transmitter only rather than a transceiver (e.g., the transceiver circuit may be a transmitter circuit) for transmitting to a device. The trainable transceiver 10 may include an additional transceiver (e.g., Bluetooth transceiver) to allow communication with the mobile communications device 16 but include only a transmitter circuit for transmitting to the home electronics device 12, remote device 18, and/or other device.

In further embodiments, the mobile communications device 16 may be used to train the trainable transceiver 10 without a user providing an input on the trainable transceiver 10. For example, a user may input information into the application 210 of the mobile communications device 16 having been paired to the trainable transceiver 10 and/or otherwise in communication with the trainable transceiver 10. The mobile communications device 16 may use one or more of the techniques described herein to retrieve information such as activation signal parameters, training information, and/or other information related to the home electronics device 12, remote device 18, and/or other device. The mobile communications device 16 may transmit this information to the trainable transceiver 10 using one or more techniques described herein. Using the information received and/or in response to an instruction received, the trainable transceiver 10 may configure itself or otherwise be configured to control a device using an activation signal (e.g., the trainable transceiver 10 is trained based on the information received from the mobile communications device 16). Thus, the trainable transceiver 10 may be trained without first receiving a user input on the trainable transceiver 10. In some embodiments, this function may be facilitated by one or more additional features or functions. For example, the communication from the mobile communications device 16 may have an instruction, header, or other information which causes the trainable transceiver 10 to enter a training mode prior to processing the information received from the mobile communications device 16. In some embodiments, the trainable transceiver 10 may send a communication to the mobile communications device 16 after being trained to confirm that the training occurred. The communication may be used to or cause the mobile communications device 16 to display a confirmation message to a user that the trainable transceiver 10 has been trained.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A trainable transceiver for controlling a remote device, comprising:

a transceiver circuit configured, based on training information, to communicate with the remote device;

a radio frequency transceiver configured to communicate with a mobile communications device; and a control circuit coupled to the transceiver circuit and coupled to the radio frequency transceiver, wherein the control circuit is configured to:

determine, in response to receiving a user input, whether the trainable transceiver is within communication range of the remote device; and send an activation transmission, responsive to a determination that the trainable transceiver is not within communication range of the remote device, to the mobile communications device via the radio frequency transceiver;

wherein the mobile communications device is configured to control the remote device within a predefined time limit and to delete the activation transmission from the control circuit subsequent to the predefined time limit elapsing; and wherein the activation transmission causes the mobile communications device to control the remote device.

2. The trainable transceiver of claim 1, wherein the control circuit is configured to receive an instruction from the mobile communications device via the radio frequency transceiver, and wherein the instruction from the mobile communications device causes the control circuit to transmit a second activation transmission to control the remote device.

3. The trainable transceiver of claim 1, wherein the mobile communications device is configured to send information of the activation transmission from the control circuit to a second mobile communications device proximate to the mobile communications device.

4. The trainable transceiver of claim 1, wherein the mobile communications device is configured to control the remote device using an application running on the mobile communications device.

5. The trainable transceiver of claim 1, wherein the activation transmission causes the mobile communications device to provide an input to the application.

6. The trainable transceiver of claim 1, wherein the mobile communications device is configured to access the internet to control the remote device via the application.

7. The trainable transceiver of claim 1, wherein the radio frequency transceiver includes one of a Bluetooth transceiver or a near field communications transceiver.

8. A trainable transceiver for operating a remote electronic device, comprising:

a user interface; and a control circuit configured to receive inputs from the user interface and to process the inputs;

wherein the trainable transceiver is configured to communicate with the remote electronic device;

wherein the trainable transceiver is further configured to communicate with at least one of a separate_transmitter, a remote device, a mobile communications device, and a network device; and wherein the trainable transceiver is further configured to determine whether the trainable transceiver is within communication range of the remote electronic device.

9. The trainable transceiver of claim 8, wherein the user interface includes a display element configured to provide an output.

10. The trainable transceiver of claim 8, wherein the transceiver circuit is configured to allow the transceiver circuit to transmit and receive wireless communication signals.

11. The trainable transceiver of claim 10, wherein the trainable transceiver is configured to use the transceiver circuit to access the internet.

12. The trainable transceiver of claim 8, wherein the control circuit is configured to communicate with and to control certain functions of a rearview mirror having a control circuit.

13. The trainable transceiver of claim 8, wherein the control circuit is configured to communicate with and to control certain functions of a remote communication device.

14. The trainable transceiver of claim 8, wherein the control circuit is configured to determine whether the trainable transceiver is in range of the home electronics device.

15. The trainable transceiver of claim 14, wherein the trainable transceiver is configured to send, responsive to a determination that the trainable transceiver is in range of the home electronics device, an activation signal to the home electronics device.

16. The trainable transceiver of claim 14, wherein the trainable transceiver is configured to send, responsive to a determination that the trainable transceiver is not in range of the home electronics device, instructions to a mobile communications device.

* * * * *